US006253517B1

(12) United States Patent
Fancher

(10) Patent No.: US 6,253,517 B1
(45) **Date of Patent: *Jul. 3, 2001**

(54) MODULAR PANEL ASSEMBLY SYSTEM

(76) Inventor: Hershel E. Fancher, 1524 Slate Run Rd., New Albany, IN (US) 47150

( * ) Notice: Subject to any disclaimer, the term of this patent is extended or adjusted under 35 U.S.C. 154(b) by 0 days.

This patent is subject to a terminal disclaimer.

(21) Appl. No.: 09/288,604

(22) Filed: Apr. 8, 1999

Related U.S. Application Data

(63) Continuation-in-part of application No. 08/941,927, filed on Oct. 1, 1997, now Pat. No. 6,018,920.

(51) Int. Cl.[7] ..... E04B 1/38; E04B 2/00

(52) U.S. Cl. ..... 52/582.2; 52/584.1; 52/240; 52/282.5; 52/270; 52/127.5; 52/127.9; 52/127.11; 52/741.1; 52/745.11; 52/745.14

(58) Field of Search ..... 52/582.1, 582.2, 52/584.1, 240, 282.5, 270, 127.9, 127.11, 741.1, 745.11, 745.14, 747.1, 127.5

(56) References Cited

U.S. PATENT DOCUMENTS 3,353,314 * 11/1967 Melcher .
3,769,768 * 11/1973 Bertrand ..... 52/154
5,134,826 * 8/1992 La Roche et al. ..... 52/584.4
6,018,920 * 2/2000 Fancher ..... 52/582.2

* cited by examiner

*Primary Examiner*—Robert Canfield
(74) *Attorney, Agent, or Firm*—Don Halgren

(57) ABSTRACT

The present invention is an improved modular panel arrangement for the assembly of a first panel to a second modular panel or a portion of a permanent wall. The arrangement comprises a modular panel of generally rectilinear configuration, having at least one edge thereon. A first corner block is attached to the edge of the panel. An elongated tensile connecting rod is pivotally attached to a pivot hinge of the first corner block, the rod having a lug disposed transversely across at least one end thereof. A second corner block is attached to the second panel or portion of the wall. The second block has at least one cammed locking finger on a base thereof, wherein the rod is swingable about the pivot hinge on the first corner block to permit the lug thereon to engage a cam surface on the second corner block to lockably secure and align the edge of the first modular panel with the second modular panel or wall. The tensile rod may be adjustable to accommodate variations in spacing of the panels and/or wall. The block may be arranged to accommodate several connecting rods simultaneously to connect two or more separate panels simultaneously.

20 Claims, 24 Drawing Sheets

MODULAR PANEL ASSEMBLY SYSTEM

The present application is a continuation-in-part application of my application Ser. No. 08/941,927, filed Oct. 1, 1997 is now U.S. Pat. No. 6,018,920, which is incorporated herein by reference in its entirety.

BACKGROUND OF THE INVENTION

1. Field of the Invention

The present invention relates to a universal connector system, and more particularly to arrangements for connecting modular panels, surfaces or partitions together and more particularly to arrangements for connecting such partitions or surfaces of modular panels together.

2. Prior Art

Sectional panels and modular walls are the frequent source of a modem office facility today. Such modular panels are assembled with included hardware, requiring assembly skill and patience, in the all too frequently arduous task of finding the pieces and putting them all together.

Desks, floors and modular panel assemblies all desperately need a system for connecting, aligning and arranging those assemblies in a neat and orderly fashion, permitting rapid assembly and disassembly as necessary.

It is an object of the present invention, to provide an improved universal connector system for walls, desks, work surfaces or floor components which require no special tools, skills or left/right-handed components.

It is a further object of the present invention to reduce the time and complexity involved required to assemble modular components for floors, walls, desks or like work surfaces.

It is a further object of the present invention, to provide a desk, modular panel and work-surface assembly arrangement utilizing a universal connector arrangement which may be pre-attached to that modular component and assembled without tools, extra parts or special assembly equipment required, which tools and extra parts are often misplaced or lost prior to assembly of such components.

It is a still further object of the present invention to provide a modular component assembly arrangement utilizing a universal connector arrangement as part of that modular component. Such an assembly arrangement is intended to permit alignment, securement, and disassembly of modular components without the need of numerous parts, assembly training or extended periods of time for accomplishing these tasks.

BRIEF SUMMARY OF THE INVENTION

The present invention comprises a tensile connector arrangement assembly for joining and aligning a plurality of modular components together. Those modular components may comprise portions of a free-standing desk and return, modular wall panels, or work-surfaces such as tables or floor surfaces. Applications include modular components which require quick and easy assembly for the end user or require repeated re-configuration.

Each tensile connector arrangement assembly includes an elongated connecting rod and a first-end joint which is disposed generally transversely with respect to the longitudinal axis of the elongated rod itself, and a second-end having a locking joint disposed generally transversely to the longitudinal axis of the connecting rod shaft. The connecting rod is shown in the aforementioned co-pending application, and in an improved embodiment, has an opening in alignment with the longitudinal axis of the shaft of the connecting rod to facilitate securement or release of the rod from a corner block to which it is attached. The opening may comprise a slit or a round opening to permit the entry of a tool therein to permit pivoting movement of the connecting rod about its first-end, which first-end pivots in a hinge in a second corner block attached to a further modular panel or the like, which hinged relationship is described in my aforementioned co-pending patent application.

The corner block for receiving the tensile connecting rod is generally similar to that of the aforementioned co-pending application, having a generally L-shaped base with a locating hole and a locating pin disposed on its outer face, and a pair of mounting holes on an upper surface to permit the mounting block to be attached to a modular panel or the like. The improved corner block of the present invention has a pair of upstanding guides arranged perpendicular to the uppermost surface, and generally parallel to a pair of pivot hinges disposed therebetween. The upstanding guides permit electrical wires to be arranged between the guides and the pivot hinges in a safe and secure manner. The improved corner block has a groove arranged in each of its side faces parallel to the upper surface, so as to permit a topcap to be slid and secured therewith. A drilled and tapped hole is arranged through the groove on each side of the improved corner block, and on which to mount a base plate. A ramp is arranged in the uppermost surface of the corner block along one side edge to permit the insertion of a flat screwdriver to help dislodge a tensile connecting rod from engagement with the cammed locking detents of the locking fingers.

In an embodiment where the corner block may be utilized along the lowermost side of a modular panel, desk component or wall assembly, a tapped hole may be arranged through the generally horizontally disposed planar surface to permit a leg to be threadably received therein, to permit adjustment of height of that particular panel. The upstanding guides may have a tapped and drilled hole therethrough, for attaching electrical or baseplates thereon.

The present invention also includes a modified corner block arrangement (a transition block) when one panel is to be attached and securely aligned to a further panel, and the first panel is somewhat shorter or lower than the second panel. The transition corner block may generally include an L-shaped corner block similar to that shown in FIGS. 6 A, B, and C of the aforementioned co-pending application. The transition connector corner block has a pair of locking fingers which extend upwardly from its location on the corner of a lower first panel, upon which is mounted an elongated high-low connector. The high-low connector has a lower knuckle joint with a pair of slots extending through that knuckle joint to mate with the locking fingers on the lowermost transition connector corner block. A second transition connector corner block is mounted on the upper end of the elongated high low connector. The high-low connector is pivotably secured to the lowermost transition connector corner block and brought into alignment with a tensile rod pivotably engaged to the pivot hinges of a full corner block mounted on the uppermost corner of an adjacent panel to which the shorter panel is attached. Upon pivoting engagement of the knuckle joint with the blocking fingers of the lowermost transition connector corner block, the connector rod is arranged to be pivoted into locking engagement with the cammed locking detents on the locking fingers of the upper transition connector corner block on the uppermost end of the high low connector.

A further embodiment contemplated for the present invention for connecting a lower or shorter panel to a taller or higher panel is disclosed wherein a full connector corner block has a track connector arranged therewith. The track connector comprises a generally triangularly shaped web of sheet material having a tapered end having an interlockable symmetric shaft extending generally transversely therefrom. The triangular web of planar material has a broad end having a plurality of fingers arranged angularly thereto. The shaft of the track connector at its narrow end, is arranged to mate with the semicircular engaging portions of the pivot hinges on the transition block to which it is attached. A pair of track connectors are arranged from each side of the corner block, each of these shafts of the pivot connectors having an interlocking bar and receiving ramp for engaging the opposing barb of its adjacent track connector. A plurality of fingers extend from the wide end of the web of the track connector and are arranged so as to engage slots on an accessory track on the adjacent larger panel to which the shorter panel is to be attached. These accessory tracks, as described on the taller panel, are common in the art for supporting shelves or accessories.

The invention further contemplates an elongated wall mount connector having a transition connector corner block arranged at each end thereof. The elongated wall mount connector has a plurality of bores therethrough to permit securement to a permanent wall by a plurality of screws or the like. The attachment of a panel onto the elongated wall mount connector and thus to the permanent wall, is accomplished by a pivotable tensile rod arranged with an upper and a lower full corner block described in the aforementioned co-pending patent application and hereinbelow.

In yet a further embodiment of the tensile rod arrangement, a wallplate may be arranged for attachment to a wall or permanent wall or the like. That waliplate has a plurality of mounting holes or attachment to that wall by screw bolts or the like. That wallplate may also have an alignment pin and an alignment hole for receiving a corresponding alignment pin and an alignment hole on a full corner block to be attached thereto. The tensile rod comprises, in this embodiment, a pair of flexible tension arms extending from the wallplate, each tension arm having a locking pin extending transversely at its distal most end, toward one another. Each pin has a chamfer to permit a corner block to be inserted thereagainst, the locking and alignment pin of the wallplate engaging the alignment hole of the corner block, the locking pins on the flexible tension arms snapping into and being received by the curvilinear surfaces of the pivot hinges on the corner block. Further embodiments of the tensile connecting rod include a wallplate having the mounting holes and alignment pin thereon, as in the aforementioned embodiment, with a single rigid internal tensile arm extending transversely therefrom. The rigid arm has a removable or a spring loaded pin thereon, which removable or spring loaded pin engages the hinge portion of the pivot hinges on a full connector block pressed thereagainst.

The invention also includes a modular panel having tensile connector arrangements arranged at each corner thereof, which panel may itself be foldable, by having the perimeter of the panels being comprised of elongated rigid frame arms which are connected to one another by a hinge. Fabric may be arranged between the frame arms, to stretch into place once the frame arms are fully pivoted into their orthogonal orientation, when that panel is to be attached to a wall or a further panel.

The corner block may be arranged as a planar form, and not L-shaped in side elevational view. In this planar embodiment, an alignment hole and an alignment pin are arranged on the abutting edge of each corner block. The block has a pair of holes for mounting onto a bottom of a work surface or planar panel, without having a side portion to extend over one edge of the panel. The planar block has a tensile connecting rod pivotably secured to the pivot hinges of each block, only one of those tensile connecting rods needing to be pivotably swung into engagement with the locking fingers of its adjacent connecting block.

In yet a further embodiment of the tensile rod, that tensile rod may be comprised of parallel elongated plates having round shafts connecting the ends of those plates therebetween. An elastic bushing maybe arranged around each of the round rods at each end of the tensile shaft to provide a certain resiliency to the tensile connecting rod when it is engaged between a pair of mounting blocks. That tensile rod between the round rods of each end thereof, may be comprised of a rigid rod having threads of opposite hand at each end thereof, similar to that as may be found in a turnbuckle. A rotating cam may be arranged at each end of the tensile connecting rod, in yet a still further embodiment thereof, which cams are supported on the ends of the tensile rod by tightenable adjustment means theretrough. The cammed arrangement on each end of the connecting rod permits adjustment of tension to compression of that rod, as necessary.

In a further view of the planar form of the connecting block, that planar block has pair of parallel side edges having a wing extending from each side thereof to permit the wings to be mounted in a slot in a work surface without the utilization of screws. That transition block also has an alignment pin at its front edge thereof and an alignment slot, thereadjacent, each to receive their respective alignment slot and alignment pin of an adjacent planar transition block. The planar transition block may be attached also to the work surface through counter sunk mounting holes, for receipt of screws therethrough. The connecting block of this embodiment has a pair of upstanding locking fingers with cammed locking detents thereon as in the aforementioned embodiments. This transition block includes a pair of side arms extending generally parallel to the locking fingers, the side arms being flexible so as to allow the hinge end or the lock end of a tensile connecting rod to snap between a retaining boss on the distal most ends of each side arm. The retaining boss fits into a recess on either the hinge or the locking end of a connecting rod arranged between two of the connecting blocks. A small boss is also arranged adjacent to the retaining boss, the boss fitting into a slot on the side of a tensile connecting rod, to maintain that tension rod into a fixed position when it is not in use or flipped against a work surface. The tensile connecting rod for this embodiment comprises an elongated shaft having a round short shaft by which the tensile connecting rod locks and or pivots when mated with the appropriate transition blocks. The shafts have a chamber or depressed radius so as to receive the boss from the flexible arms on the transition blocks. A radial groove is arranged at two locations on the pivot end of the tensile connecting rod, and a radial groove is arranged at one location on the locking end of that tensile connecting rod. Those grooves are arranged to receive the small boss when the tensile connecting rod is in its locked or unlocked position so as to help hold it in place. An L-shaped lever extends off of the rounded shaft on the locking end of the tensile connecting rod, to permit the tensile rod to be manually engaged or disengaged on or under a work surface to which the transition blocks are attached.

Thus it has been shown a novel and unique arrangement for securely aligning and connecting a plurality of modular components together or towards a pre-existing wall or structure. The tensile connector arrangement assembly includes a pair of transition blocks, one on each panel or wall surface, one each arranged to pivotably hold a tensile connecting rod, the other arranged to receive and securely lock that tensile connecting from the first transition block. Each of the transition blocks have a pin and detent arrangement to permit proper alignment between the respective transition blocks and thus the panels or wall surfaces being connected.

The invention thus comprises a modular panel arrangement for the assembly of a first panel to a second modular panel or a portion of a wall, comprising: a modular panel of generally rectilinear configuration, having at least one edge thereon; a first corner block attached to the edge of the panel; an elongated tensile rod pivotally attached to a pivot hinge of the first corner block, the rod having a lug disposed transversely across at least one end of the rod; and a second corner block attached to the second panel or portion of the wall, the second block having at least one cammed locking finger on a base thereof, wherein the tensile rod is swingable about the pivot hinge on the first corner block to permit the lug thereon to engage a cam surface on the second corner block to lockably secure and align the edge of the first modular panel with the second modular panel or wall. The tensile rod comprises an elongated shaft with an opening at one end thereof, the opening arranged to permit a tool to be inserted therein to facilitate unlocking of the lug from the second corner block. An elastic bushing may be arranged about the transverse lug. The elongated shaft of the tensile rod may be threaded on at least one end thereof. The lug may be adjusted with respect to the locking finger by rotating the threaded shaft of the tensile rod. The lug may be a rotatable cam to permit rotative adjustment of the tensile rod with respect to the locking finger. There may be at least one upstanding guide arranged adjacent to pivot hinge to permit management of wires or the like on the corner block. An outer face may be arranged on one end of the corner block, the outer face having a pin locating hole thereon to permit a second block to be properly aligned therewith by a locating pin engaged therewithin. The outer face may have a locating pin thereon to permit the first block to be properly aligned with a second block. The corner block may also comprise an elongated extrusion having an arrangement of cammed fingers on an upper end, and a knuckle joint at a lower end thereof, the knuckle joint engaging an arrangement of cammed fingers so as to engage the elongated extrusion corner block to the first panel. The corner block may include a leg threadedly attached thereto, to permit height adjustment of a first panel to which the first block is attached. The arrangement may include a track connector having a narrow first end with a shaft transversely arranged thereon, and a wide second end with a plurality of engaging fingers extending therefrom. The shaft would be arranged to mate with the pivot hinge on the first corner block and the fingers are arranged to mate with an accessory track attached to the second panel or wall portion. The second corner block may comprise a flat plate with at least one tension arm extending perpendicularly therefrom. The flexible arm may having a pin on its distalmost end for engagement with the pivot hinge on the first corner block. The second corner block may be attached to a portion of a wall. The first modular panel may be comprised of a plurality of rigid frame arms connected by a hinge arrangement at their corners. The frame members may be covered with a flexible fabric, to permit the first panel to be folded into a compact space. The locking finger on the second corner block may have a curved boss which engages a recess on the end of the lug on the tensile rod. The cammed locking finger may be pivotally arranged on the second corner block and be spring loaded on the base to permit the locking finger to move to allow a tensile rod to be readily engaged thereon, with a rigid locking finger arrangement thereadjacent.

The invention also includes a method for the joining of a first modular panel to a second modular panel or portion of a wall, comprising the steps of: a method of assembly a modular panel arrangement including a first panel to a second modular panel or a portion of a wall; arranging a modular panel of generally rectilinear configuration, having at least one edge thereon adjacent a second modular panel or portion of a wall; attaching a first corner block attached to the edge of the panel; connecting an elongated tensile rod to a pivot hinge of the first corner block, the rod having a lug disposed transversely across at least on end of the rod; and attaching a second corner block attached to the second panel or portion of the wall, the second block having at least one cammed locking finger on a base thereof, and swinging said tensile rod about the pivot hinge on the first corner block to permit the lug thereon to engage a cam surface on the second corner block to lockably secure and align the edge of the first modular panel with the second modular panel or wall.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
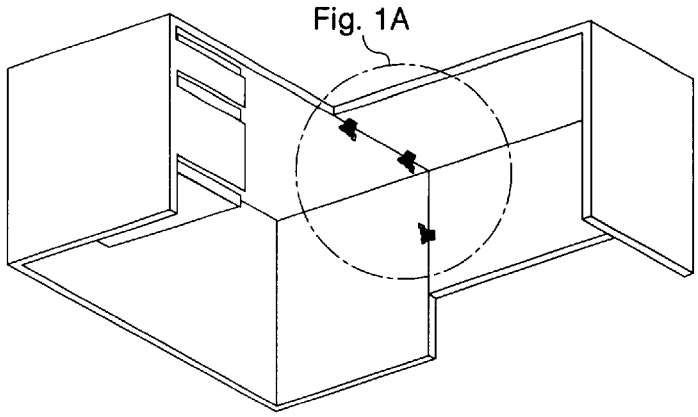
FIG. 1 is a perspective view of the underside of a freestanding desk and return, connected by a plurality of tensile connector arrangement assemblies.
Figure 1A:
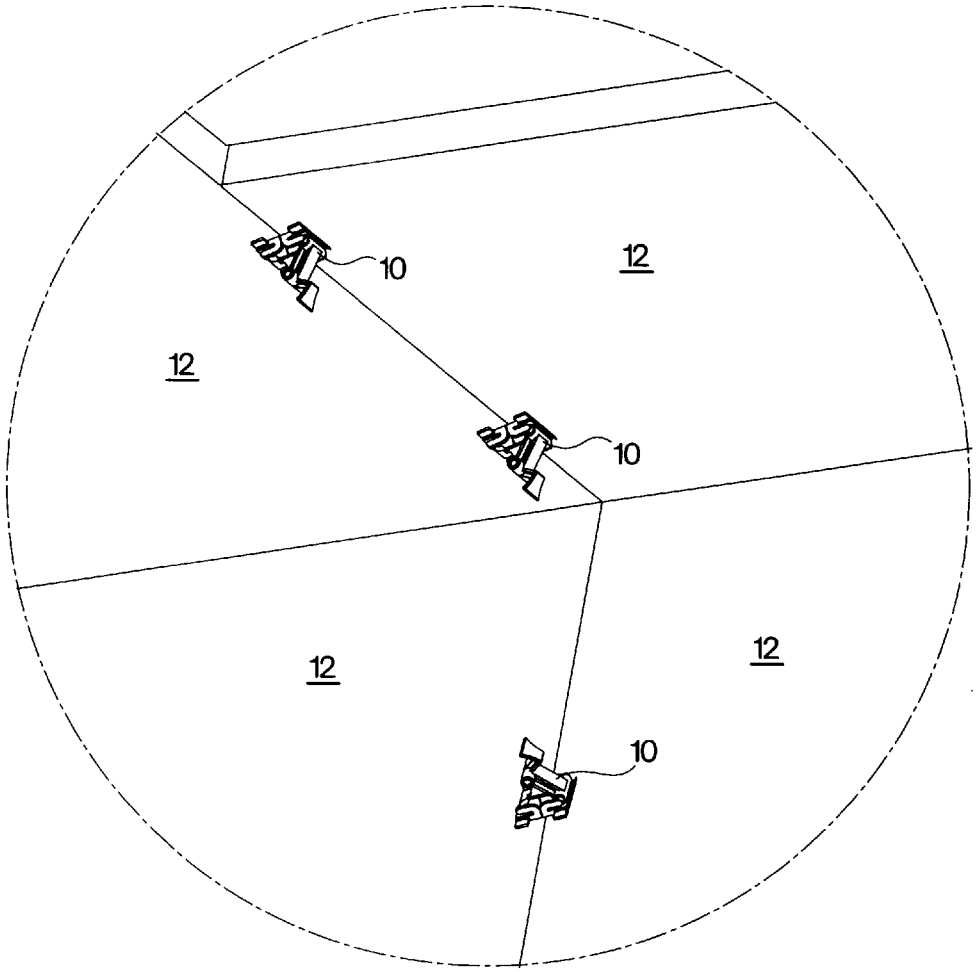
FIG. 1*a* is an enlarged view of the tensile connector arrangements mounted on the desk and return of FIG. 1.
Figure 2:
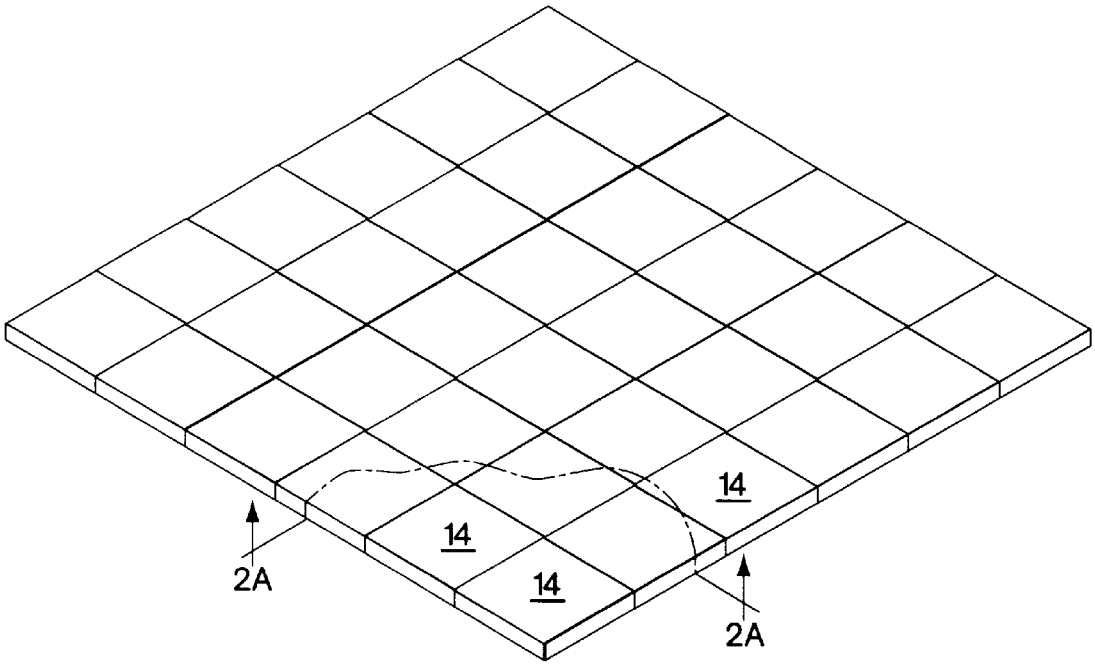
FIG. 2 is a perspective view of a work surface or a floor showing a plurality of modular panels.
Figure 2A:
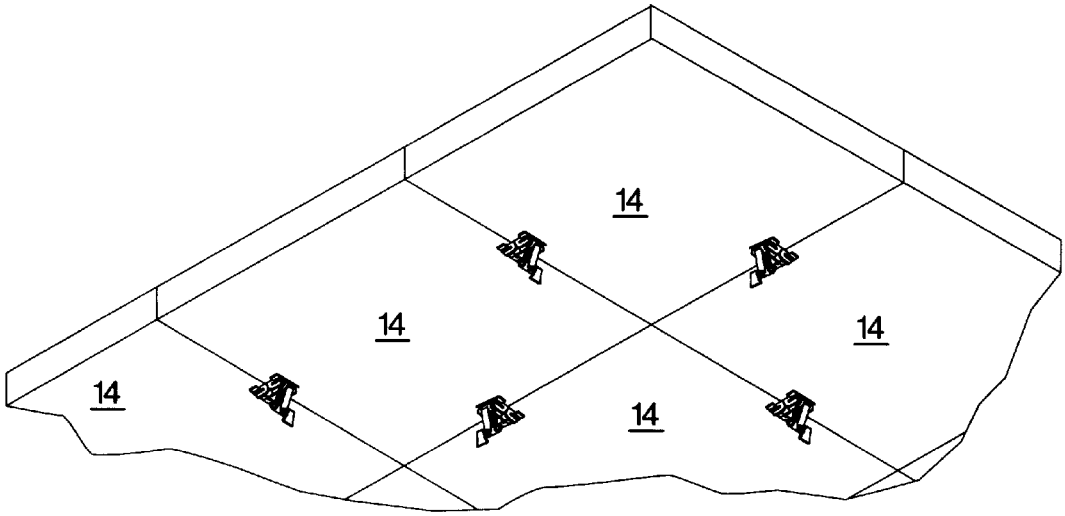
FIG. 2A is a view taken along the lines 2A—2A in FIG. 2 showing panels attached together by a plurality of tensile connector arrangements.

Referring now to the drawings, and particularly to FIGS. 1 and 1*a*, there is shown a tensile connector arrangement assembly 10 for joining and aligning a plurality of modular components 12 together. Those modular components 12 may comprise portions of a free-standing desk and return, as shown in FIG. 1, modular wall panels 14, or work-surfaces such as tables or floor surfaces, as shown in FIGS. 2 and 2A.

Figure 3:
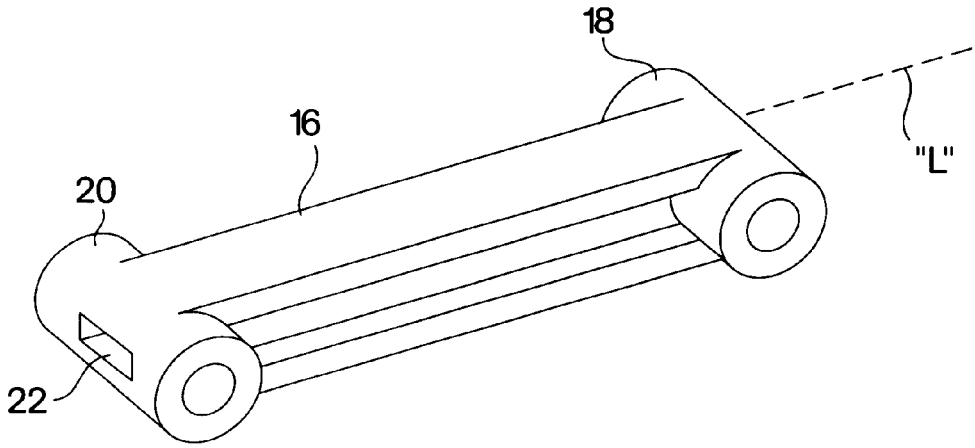
FIG. 3 is a perspective view of a tensile connecting rod.

Each tensile connector arrangement assembly 10 includes an elongated connecting rod 16 and a first-end joint 18 which is disposed generally transversely with respect to the longitudinal axis of the elongated rod 16 itself. A second-end having a locking joint 20 disposed generally transversely to the longitudinal axis "L" of the connecting rod shaft 16, may be seen in an exemplary preferred embodiment in FIG. 3. In a preferred embodiment however, as is presently shown in FIG. 3, the rod 16 has an opening 22 in alignment with the longitudinal axis "L" of the shaft of the connecting rod 16 to facilitate securement or release of the rod from a corner block to which it is attached. The opening 22 may comprise a slit or a round opening to permit the entry of a tool therein to permit pivoting movement of the connecting rod 16 about its first-end joint 18, which first-end joint 18 pivots in a hinge 40 in a second corner block attached to a further modular panel or the like, with a preferred improved embodiment of the present invention being now shown in FIG. 4.

Figure 4:
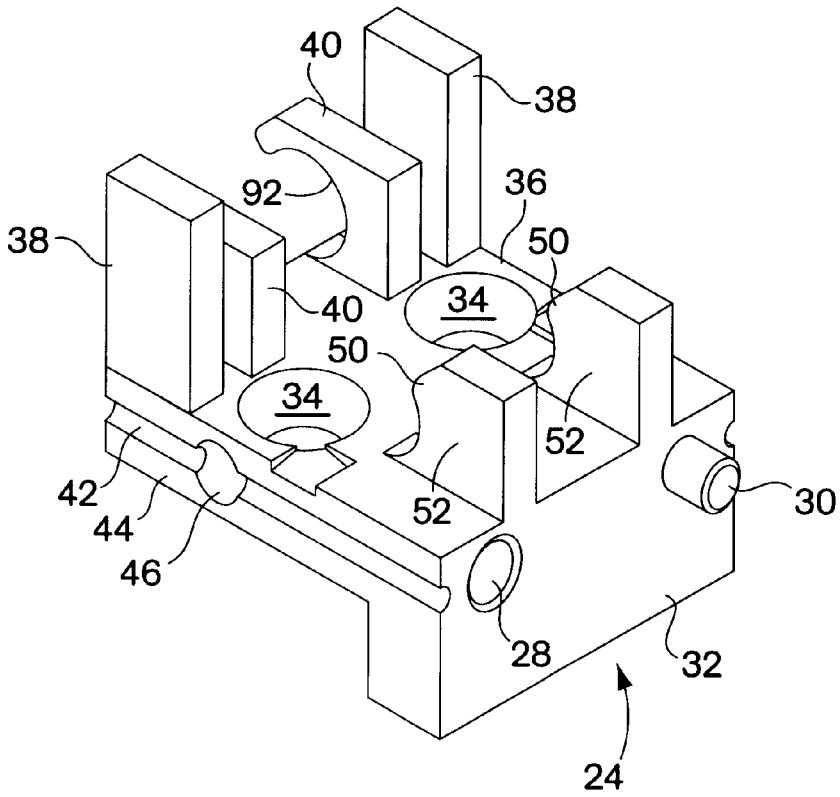
FIG. 4 is a perspective view of a full corner block.

The corner block 24 of the present invention, for receiving the tensile connecting rod 16, is an improvement over that of the aforementioned co-pending application, having a generally L-shaped base 26 with a locating hole 28 and a locating pin 30 disposed on its outer face 32, and a pair of mounting holes 34 on an upper surface 36 to permit the mounting block 24 to be attached to a modular panel 14 or the like. The improved corner block 24 of the present invention, as shown in FIG. 4, has a pair of upstanding guides 38 arranged perpendicular to the uppermost surface 36, and generally parallel to a pair of pivot hinges 40. The pivot hinges 40 are arranged to receive the first end joint 18 of a tensile rod 16 therebetween. The upstanding guides 38 permit electrical wires, not shown, to be arranged and safely contained between the guides 38 and the pivot hinges 40 in a safe and secure manner. The improved corner block 24 has a groove 42 arranged in each of its side faces 44 parallel to the upper surface 36, so as to permit a top cap (not shown for clarity) to be slid and secured therewith. A drilled and tapped hole 46 may be arranged through the groove on each side face 44 of the improved corner block 24, on which to mount a base plate (also not shown for clarity). A ramp 48 is arranged in the uppermost surface 36 of the improved corner block 24 along at least one side edge, as may be seen in FIG. 4, to permit the insertion of a flat screwdriver to help pry up and dislodge a tensile connecting rod 16 from its engagement with the cammed locking detents 50 of the locking fingers which hold the locking joints 18 or 20.

Figure 5:
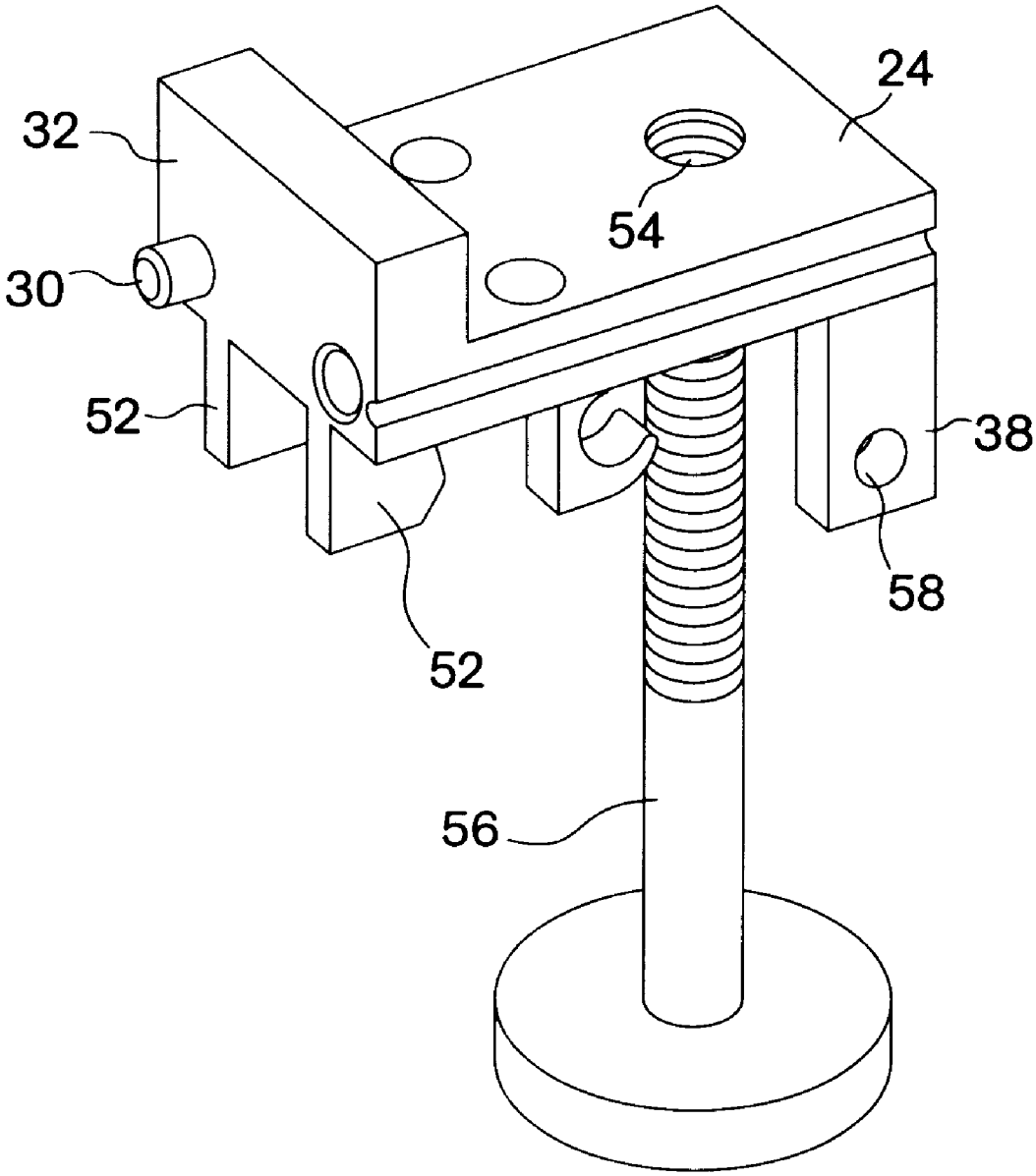
FIG. 5 is a perspective of a corner block with an adjustable leg arranged therewith.

In a preferred embodiment shown in FIG. 5, the improved corner block 24 may be utilized along the lowermost side of a modular panel, desk component or wall assembly (not shown), and a tapped hole 54 may be arranged through the generally horizontally disposed planar surface 36 to permit a threaded leg 56 to be threadably received therein, to permit adjustment of height of that particular panel to which the improved corner block 24 is attached. The upstanding guides 38 may also have a tapped and drilled hole 58 therethrough, for attaching electrical or baseplates thereon.

Figure 6:
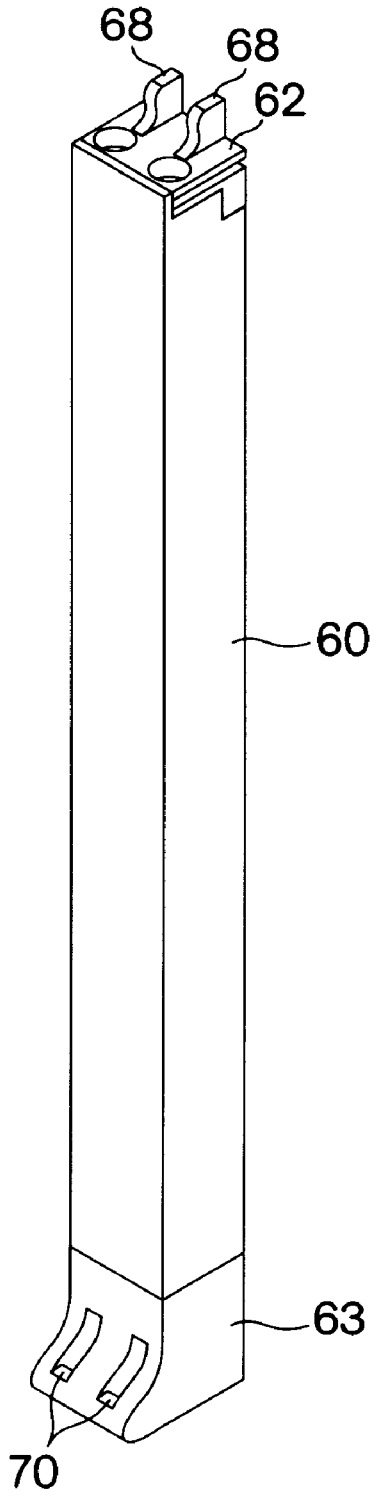
FIG. 6 is a perspective view of a high-low connector.
Figure 6A:
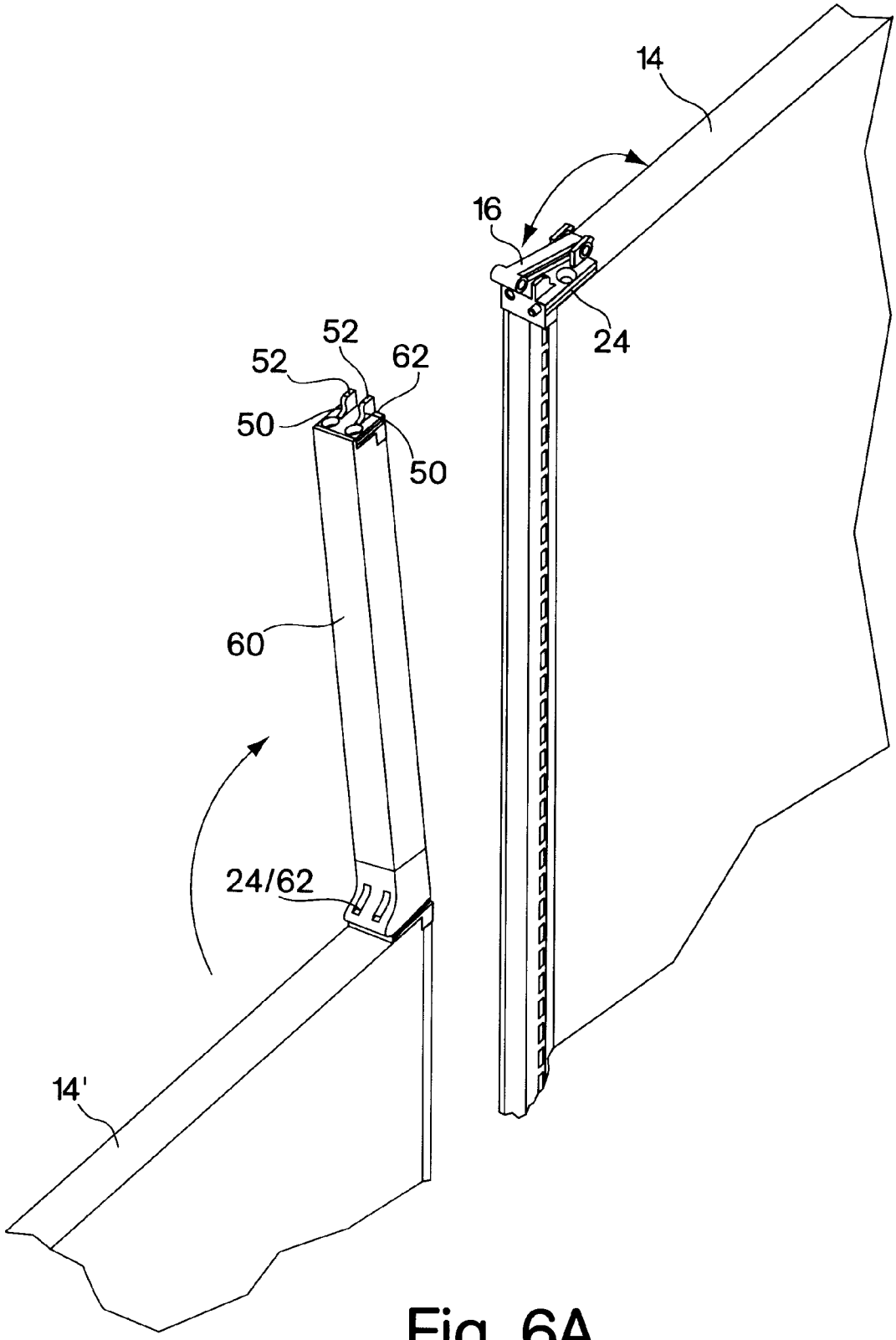
FIG. 6A is a perspective views of a high-low connector arranged between a pair of panels.
Figure 6B:
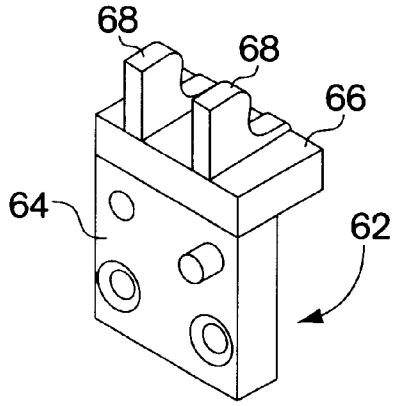
FIG. 6B–D are perspective views of transition corner blocks utilized with the high-low connector.
Figure 6C:
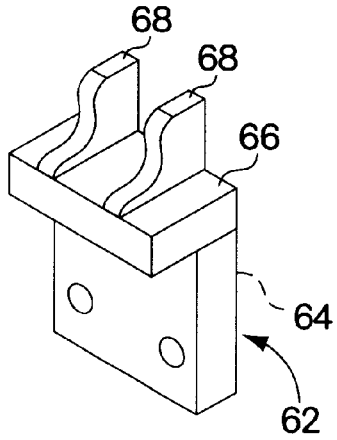
Figure 6D:
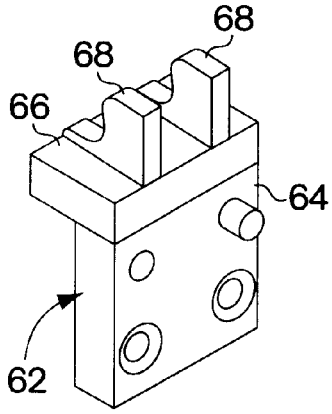

The present invention also includes a modified hi-lo corner block arrangement 60 (an elongated transition block), as shown in FIG. 6, utilized when one panel is to be attached and securely aligned to a further panel, and the first panel is somewhat shorter or lower than the second panel, as may be seen in FIG. 6A. The hi-lo connector block 60 may be connected to a standard corner block 24 or may generally include an L-shaped corner block 62 similar to that shown in FIGS. 6B, 6C and 6D on an upper end thereof, and a knuckle joint 63 on a lower end thereof, arranged to engage a corner block therewithin. Each transition corner block 62 is comprised of a first face 64 and a second face 66 perpendicular thereto, having only finger portions 68 extending therefrom. One embodiment contemplates mounting holes for screws immediately adjacent the finger portions 68 (not shown herein for clarity). The transition connector corner block 62 locking fingers 68 upon which is mounted the elongated high-low connector 60. The high-low connector 60 has the lower knuckle joint 63 with a pair of slots 70 extending through that knuckle joint 63 to mate with the locking fingers 68 on the lowermost transition connector corner block 24. A second transition connector corner block 62 is mounted on the upper end of the elongated high low connector 60 as shown in FIGS. 6 and 6A. The high-low connector 60 is pivotably secured to the lowermost transition connector corner block 24 and brought into alignment with a tensile rod 16 which pivotably engaged to the pivot hinges 40 of a full corner block 24 mounted on the uppermost corner of an adjacent panel 14 to which the shorter panel 14' is to be attached. Upon pivoting engagement of the knuckle joint 63 with the locking fingers 68 of the lowermost connector corner block 24, the connector rod 16 is arranged to be pivoted into locking engagement with the cammed locking detents 50 on the locking fingers 52 of the upper transition connector corner block 62 on the uppermost end of the high low connector 60 to thus connect the panels 14 and 14' together.

Figure 7A:
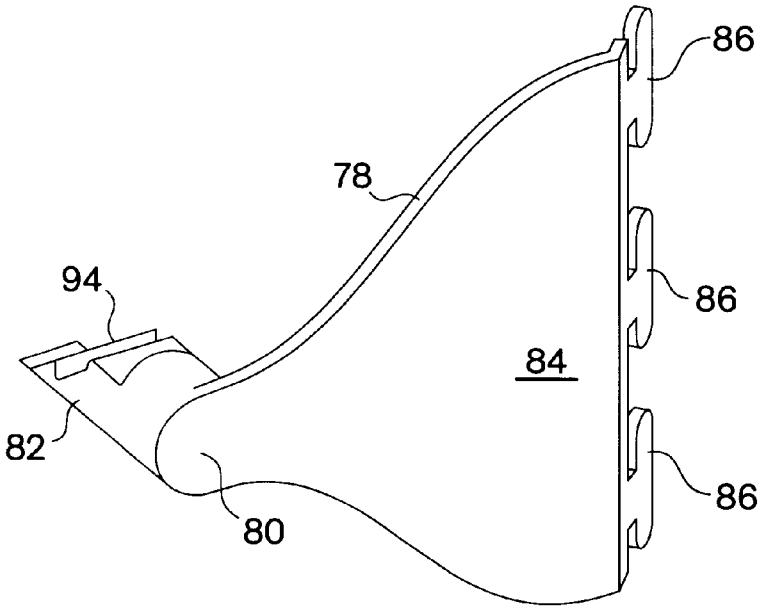
FIG. 7*a* is a perspective view of an accessory track connector.
Figure 7B:
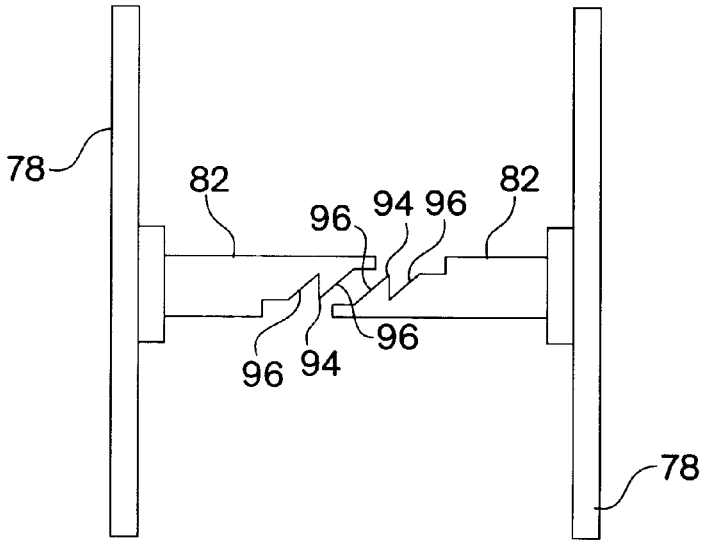
FIG. 7*b* is an end view of a pair of accessory track connectors shown in 7*a;*
Figure 7C:
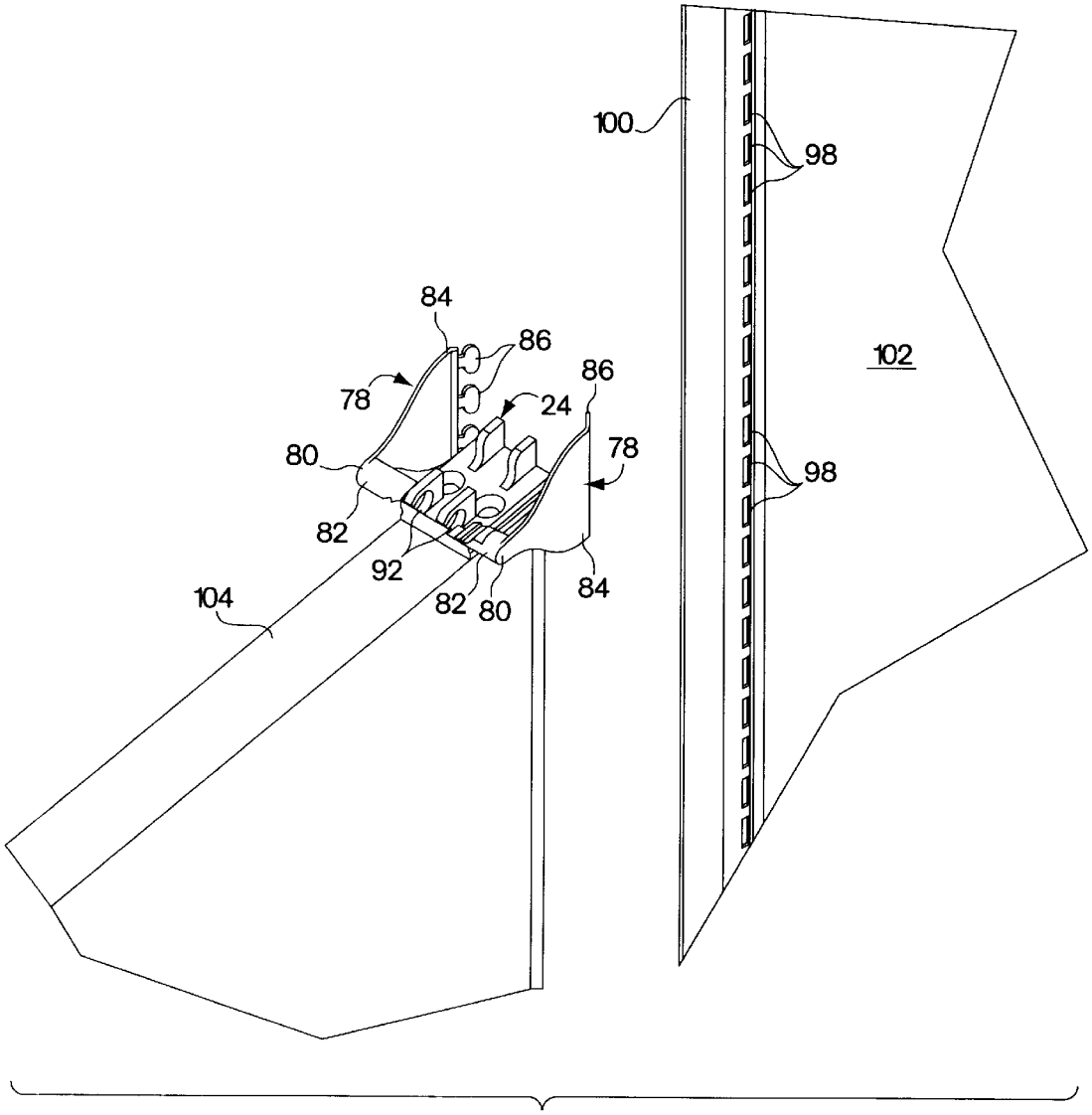
FIG. 7*c* is a perspective view of a pair of accessory track connectors attached to a corner block on a modular panel.

A further preferred embodiment contemplated for the present invention for connecting a lower or shorter panel to a taller or higher panel is disclosed wherein a full connector corner block 24, as may be seen in FIG. 7*c*, has a track connector 78 arranged therewith. The track connector 78 comprises a generally triangularly shaped web of sheet material having a tapered end 80 having an interlockable symmetric shaft 82 extending generally transversely therefrom, as may be seen in FIGS. 7A and 7B. The triangular web of planar material has a broad end 84 having a plurality of fingers 86 arranged angularly thereto. The shaft 82 of the track connector 78 at its narrow end 80 is arranged to mate with the semicircular engaging portions 92 of the pivot hinges on the transition block 24 to which it is attached. A pair of track connectors 78 are arranged from each side of the corner block 24, each of the shafts 82 of the track connectors 78 having an interlocking barb 94 and receiving ramp 96 for engaging the opposing barb of its adjacent track connector, as shown in FIG. 7*c*. The plurality of fingers 86 extending from the wide end 84 of the web of the track connector 78 are arranged so as to engage slots 98 on an accessory track 100 on the adjacent larger panel 102 to which the shorter panel 104 is to be attached. These accessory tracks 100, as described and as shown in FIG. 7*c* on the taller panel, are common in the art for supporting shelves or accessories.

Figure 8:
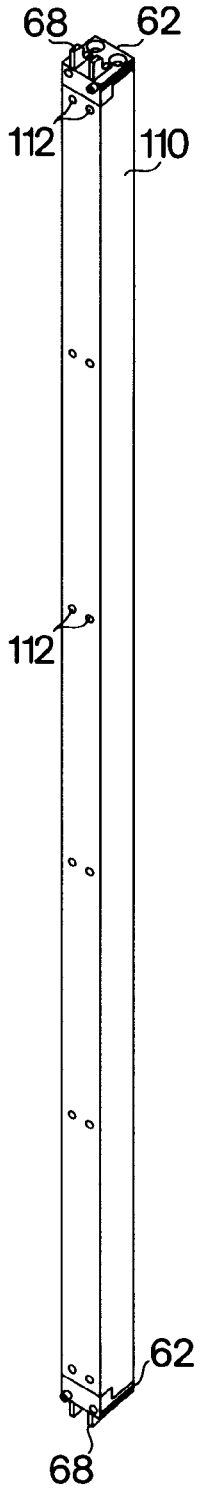
FIG. 8 is a perspective view of a wall mount connector having a transition corner block arranged at each end thereof.
Figure 8A:
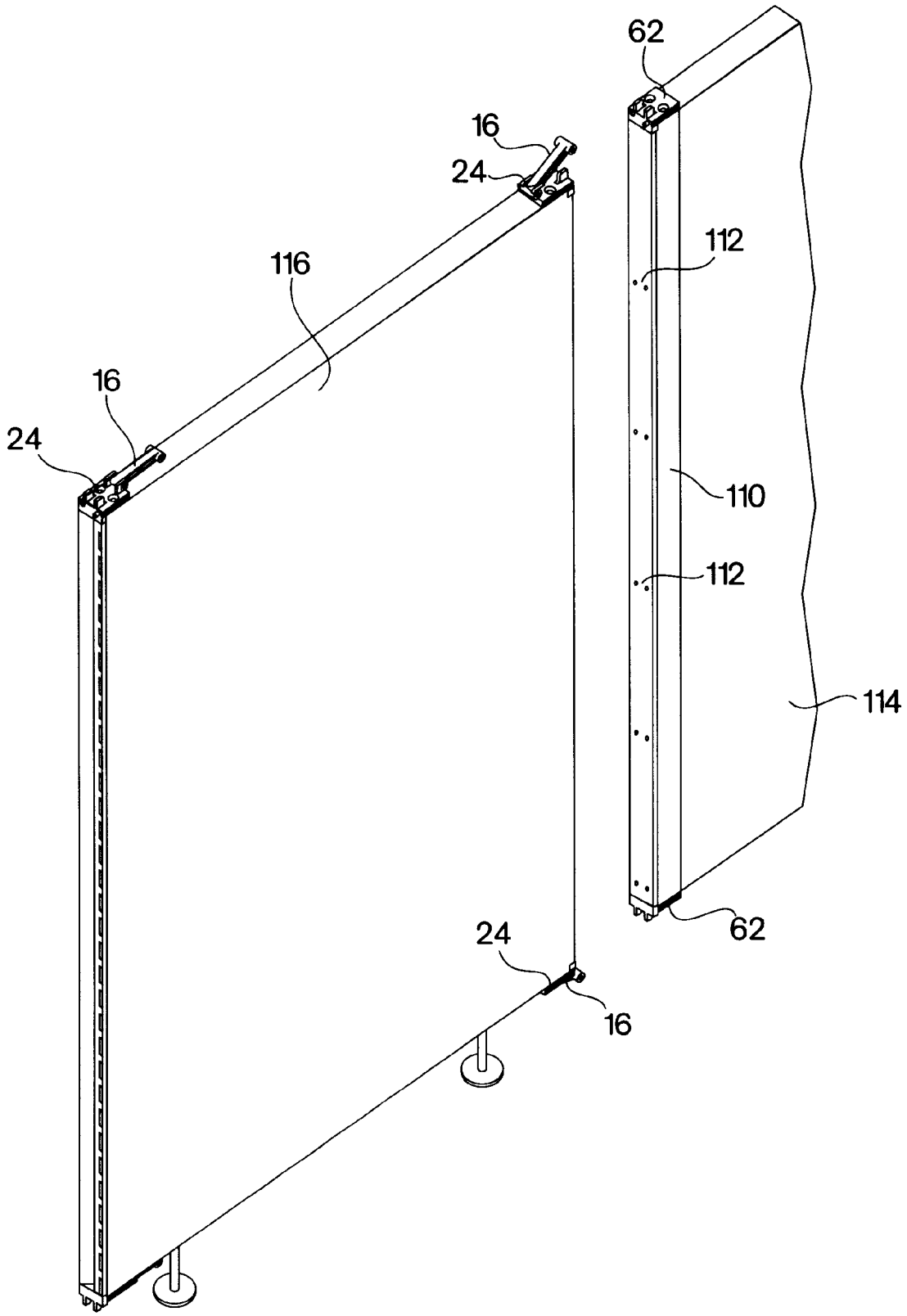
FIG. 8*a* is a perspective view of an elongated wall mount connector attached to a permanent wall with a modular panel and a tensile connector apparatus attached to thereto.

The invention further contemplates an elongated wall mount connector 110 having a transition connector corner block 62 arranged at each end thereof, as may be seen in FIG. 8. The elongated wall mount connector 110 has a plurality of bores 112 therethrough to permit securement to a permanent wall 114 by a plurality of screws or the like. The attachment of a panel 116 onto the elongated wall mount connector 110 and thus to the permanent wall 114 is accomplished by a pivotable tensile rod 16 shown in FIG. 3, arranged with an upper and a lower full corner block 24 shown in FIG. 4 and described in the aforementioned co-pending patent application and hereinbelow, and as is shown in FIG. 8*a*.

Figure 9:
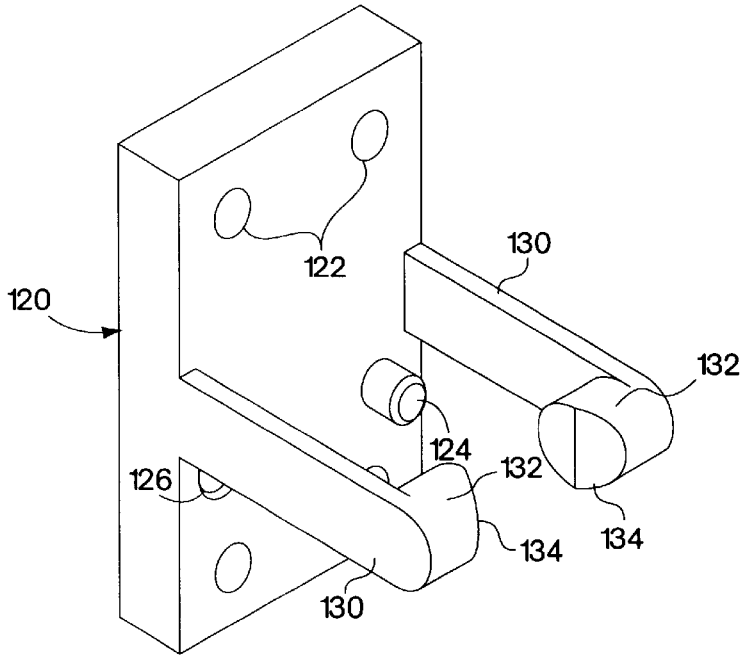
FIG. 9 is a further embodiment of the tensile connector rod arrangement for attachment to a non-modular component.
Figure 9A:
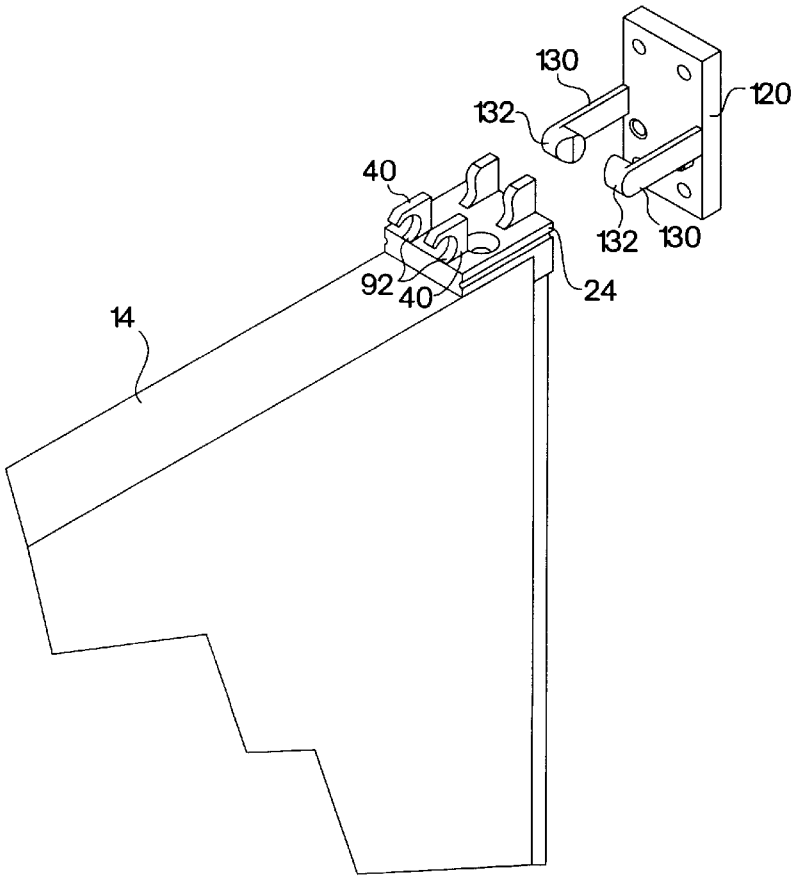
FIG. 9*a* is a perspective view of the tensile connector rod arrangement shown in FIG. 9 and a transition corner block mounted on a modular panel.
Figure 10A:
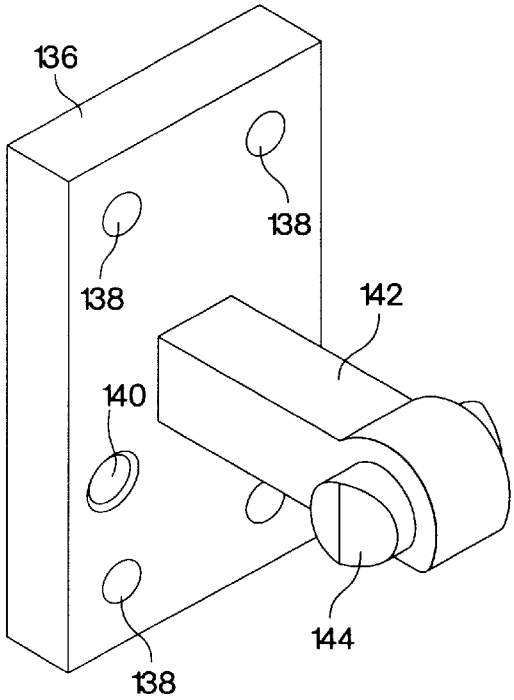
FIGS. 10*a* and 10*b* are further embodiments of a tensile connector rod arrangement.
Figure 10B:
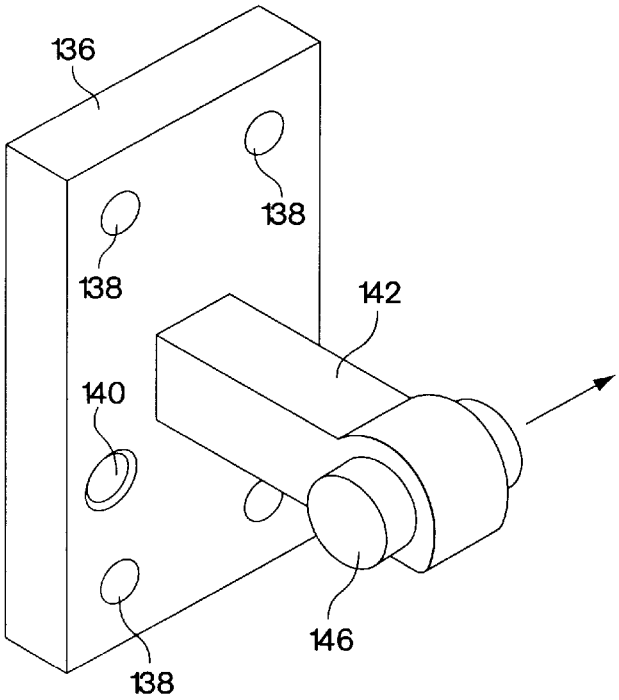
Figure 10C:
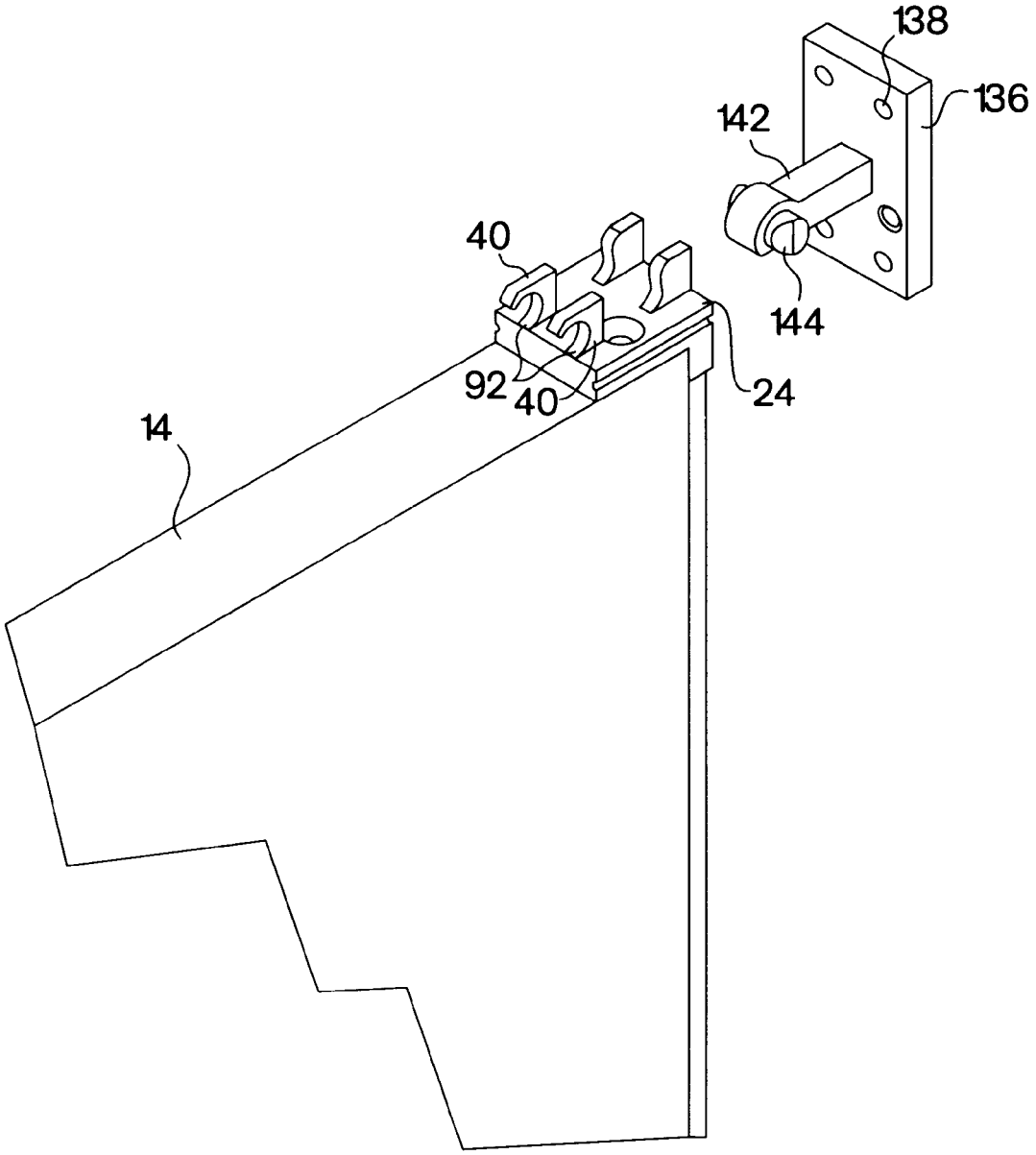
FIG. 10*c* is a perspective view of a tensile rod arrangement shown in FIG. 10*a* with a corner block arranged on a modular panel.
Figure 11:
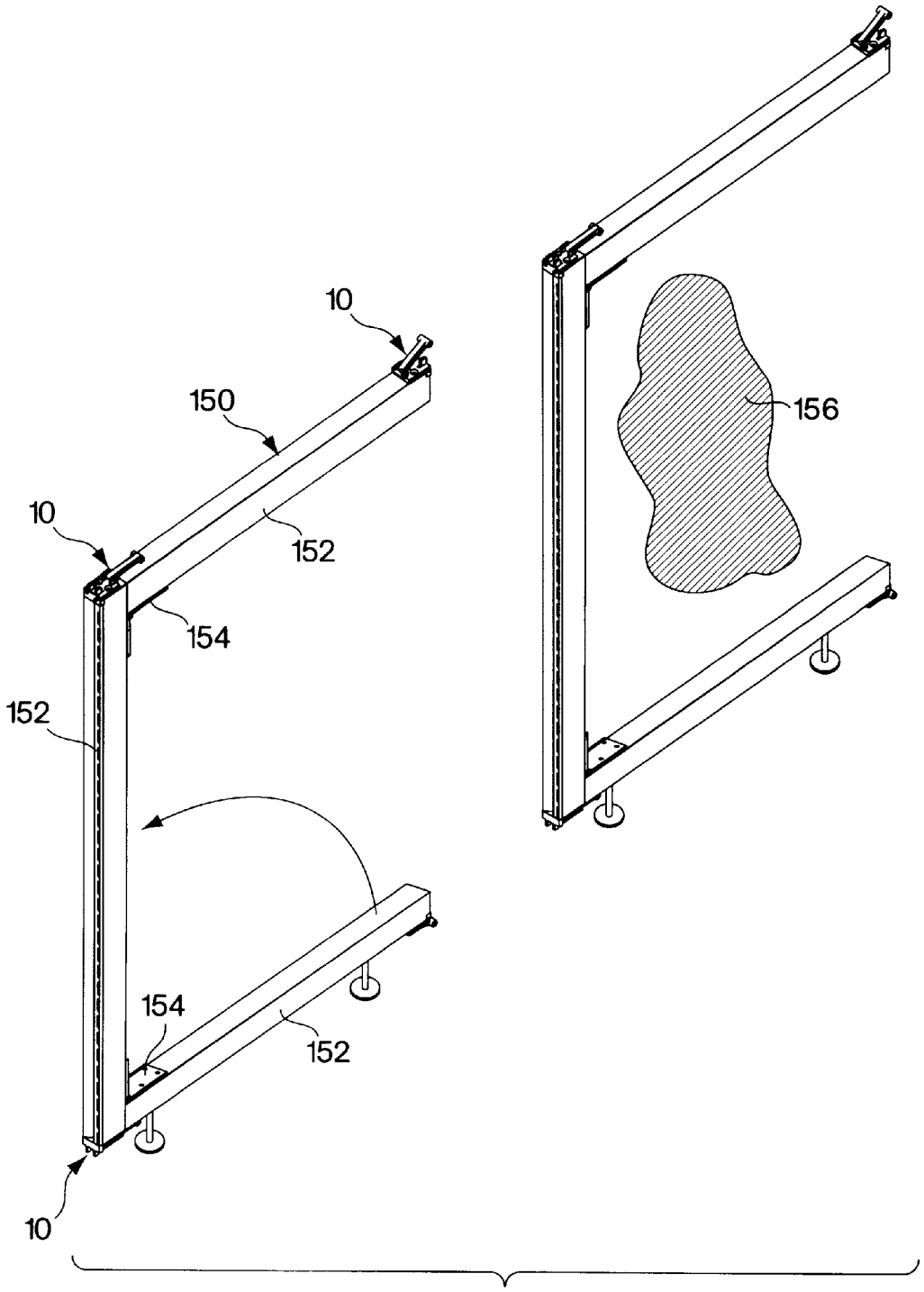
FIG. 11 shows a modular panel having elongated perimeter portions which are foldable with respect to one another, those elongated portions having the tensile connector arrangement assemblies thereon.

In yet a further preferred embodiment of the tensile rod arrangement shown in FIG. 9, a wallplate 120 may be arranged for attachment to a wall or permanent wall or the like. That wallplate 120 has a plurality of mounting holes 122 for attachment to that wall by screw bolts or the like. That wallplate 120 may also have an alignment pin 124 and an alignment hole 126 for receiving a corresponding alignment pin 30 and an alignment hole 28 on a full corner block 24 (as seen in FIG. 4) to be attached thereto. The wallplate 120 comprises, as shown in this embodiment in FIG. 9, a pair of flexible tension arms 130 extending from the wallplate 120, each tension arm 130 having a locking pin 132 extending transversely at its distal most end, toward one another. Each pin 132 has a chamfer 134 to permit a corner block 24 to be inserted thereagainst, the locking and alignment pin 124 of the wallplate 120 engaging the alignment hole 28 of the corner block 24, the locking pins 132 on the flexible tension arms 130 snapping into and being received by the curvilinear surfaces 92 of the pivot hinges 40 on the corner block 24, as exemplified in FIG. 9A. Further embodiments of the preferred tensile connecting rod include a wallplate 136 having the mounting holes 138 and alignment pin hole 140 thereon, as in the aforementioned embodiment, with a single rigid internal tensile arm 142 extending transversely therefrom, as shown in figure 10*a*. The rigid arm has a spring loaded pin 144 (as may be seen in figure 10A) or a removable pin 146 (as may be seen in figure 10B) thereon, which removable or spring loaded pin 146 or 144 engages the curved hinge portion 92 of the pivot hinges 40 on a full connector block 24 pressed thereagainst, as represented in figure 10C.

The invention also includes a modular panel 150, as shown in FIG. 1, having a tensile connector assembly 10 arranged at each corner thereof, which panel 150 may itself be foldable, by having the perimeter of the panels being comprised of elongated rigid frame arms 152 which are connected to one another by a hinge 154. Fabric 156 may be arranged between the frame arms 152, to stretch into place once the frame arms 152 are fully pivoted into their orthogonal orientation, when that panel 150 is to be attached to a wall or a further panel.

Figure 12:
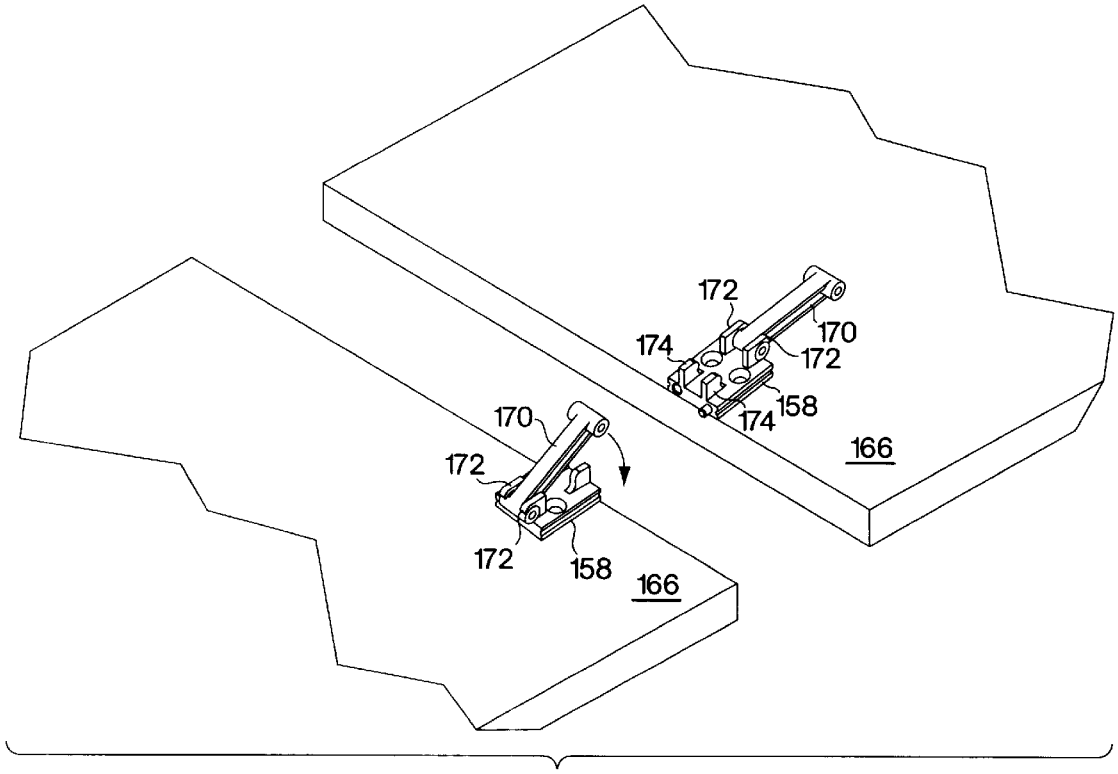
FIG. 12 shows a further embodiment of a corner block and tensile rods between a pair of panels.
Figure 12A:
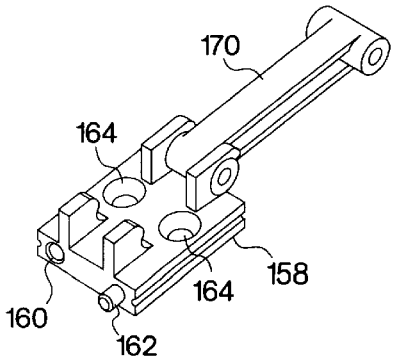
FIG. 12*a* is an enlarged view of one of the tensile connector arrangements.

The corner block of the present invention may be arranged as a planar form having a flat base block 158, as may be seen in FIGS. 12 and 12*a*, (and not L-shaped in side elevational view, as shown in FIG. 4). In this planar embodiment, an alignment hole 160 and an alignment pin 162 are arranged on the abutting edge of each corner block. The block 158 has a pair of holes 164 for mounting onto a bottom of a work surface or planar panel 166, without having a side portion to extend over one edge of the panel. The planar block 158 has a tensile connecting rod 170 pivotably secured to the pivot hinges 172 of each block, only one of those tensile connecting rods 170 needing to be pivotably swung into engagement with the locking fingers 174 of its adjacent connecting block 158.

Figure 13:
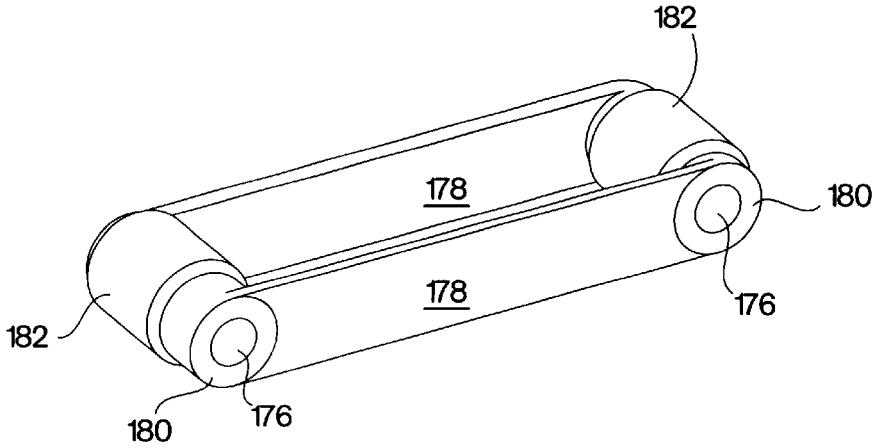
FIG. 13 is a further embodiment of a rigid connecting rod.
Figure 13A:
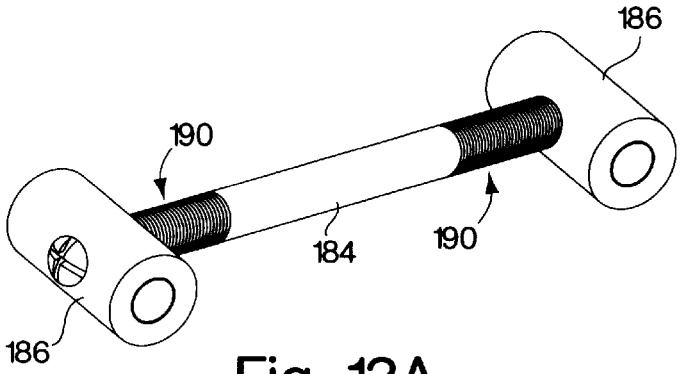
FIG. 13*a* is a further embodiment of a tensile connecting rod.
Figure 13B:
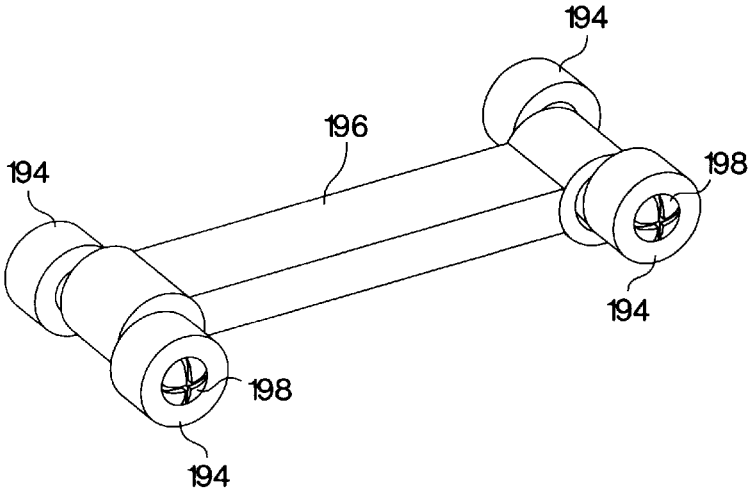
FIG. 13*b* is a further embodiment of a tensile connecting rod with a cam thereon.

In yet a further preferred embodiment of the tensile rod, as shown in FIG. 13, a tensile rod 176 may be comprised of parallel elongated plates 178 having round shafts 180 connecting the ends of those plates 178 therebetween. An elastic bushing 182 may be arranged around each of the round rods 180 at each end of the tensile shaft 178 to provide a certain resiliency to the tensile connecting rod 178 when it is engaged between a pair of mounting blocks 24 or 158. That tensile rod 184 between the round rods 186 of each end thereof, in a yet further embodiment as shown in FIG. 13*a*, may be comprised of a rigid rod having threads 190 of opposite hand at each end thereof, similar to that as may be found in a turnbuckle. A rotating cam 194 may be arranged at each end of the tensile connecting rod 196, in yet a still further embodiment thereof, as shown in FIG. 13*b*, which cams 194 are supported on the ends of the tensile rod 196 by tightenable adjustment means 198 therethrough. The cammed arrangement 194 on each end of the connecting rod 196 permits adjustment of tension to compression of that rod 196, as necessary.

Figure 14B:
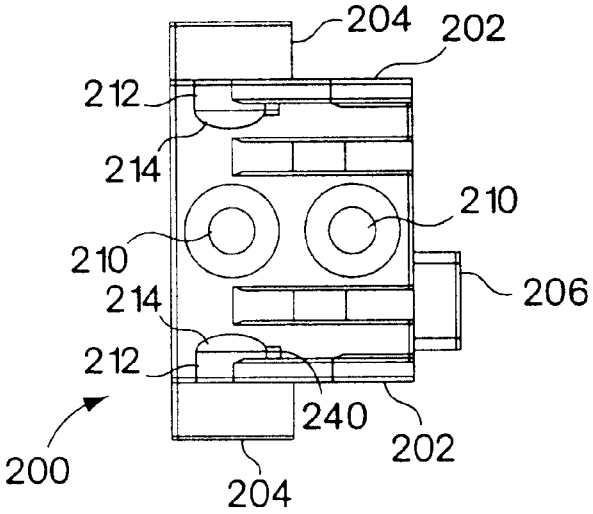
FIGS. 14A and 14B are further embodiments of the connecting block for holding a tensile connecting rod.
Figure 14A:
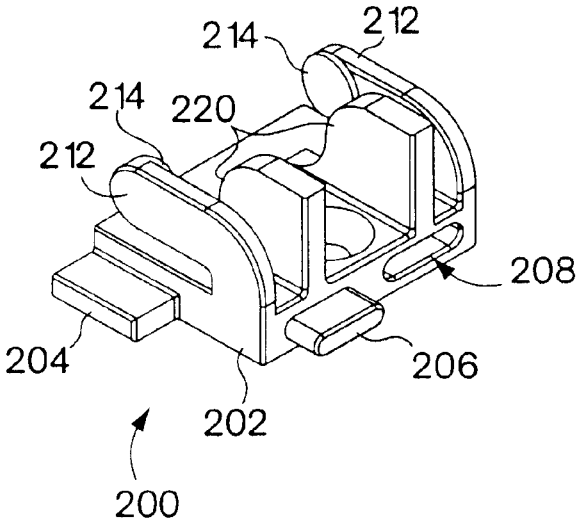
Figure 15A:
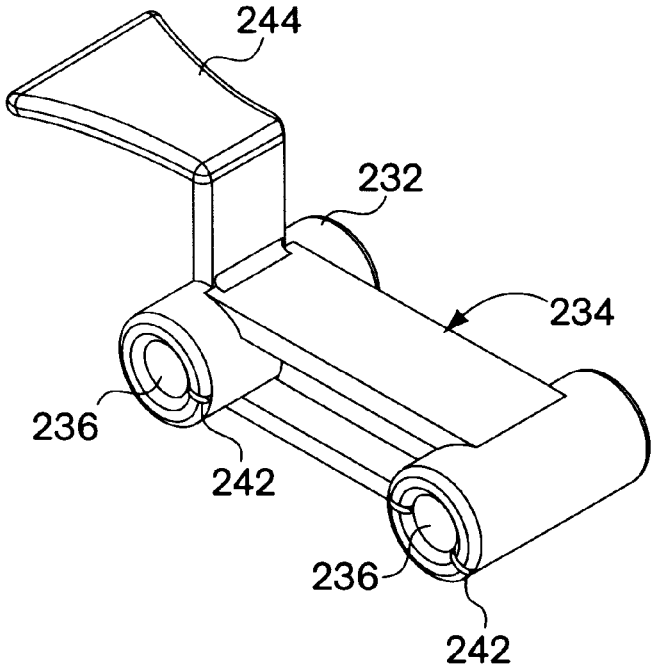
FIGS. 15A and 15B are views of a further embodiment of a connecting rod.
Figure 15B:
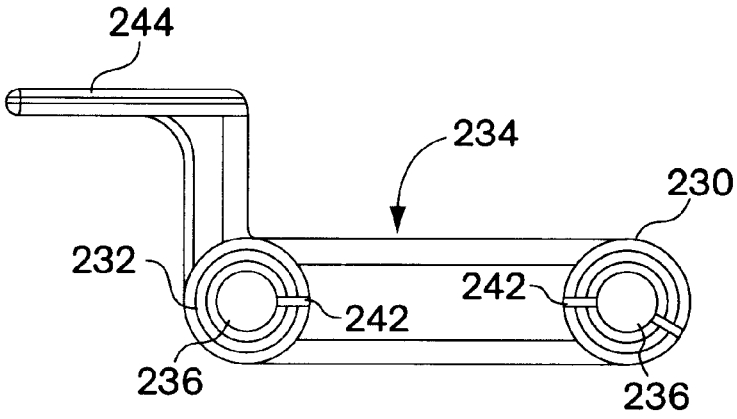
Figure 16A:
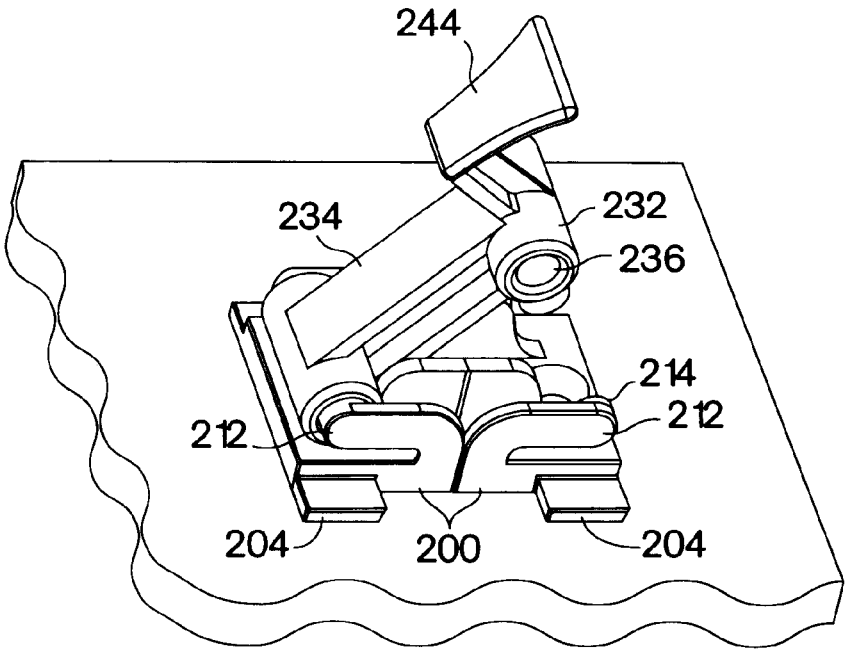
FIGS. 16A and 16B are views of the further embodiments of the transition block and tensile connecting rods.
Figure 16B:
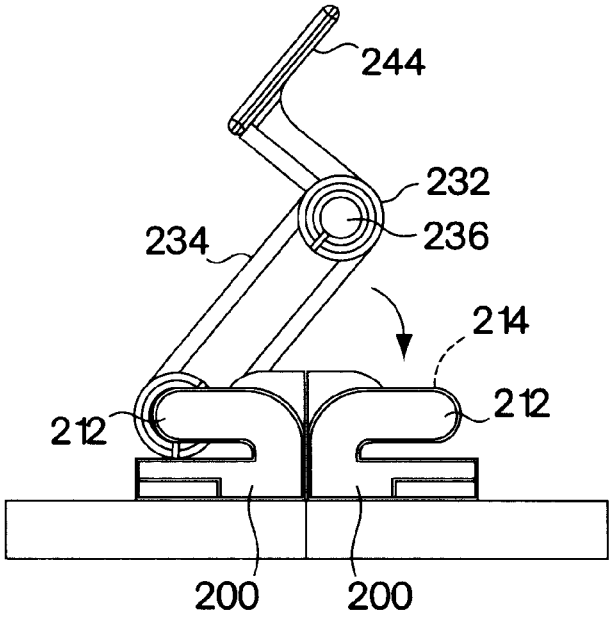

In a further view of the planar form of the connecting block, that planar block 200 has pair of parallel side edges 202 having a wing 204 extending from each side thereof, as shown in FIGS. 14*a* and 14*b*, to permit the wings 204 to be mounted in a slot in a work surface (not shown) without the utilization of screws. That transition block 200 also has an alignment pin 206 at its front edge thereof and an alignment slot 208, thereadjacent, each to receive their respective alignment slot and alignment pin of an adjacent planar transition block. The planar transition block 200 may be attached also to the work surface through countersunk mounting holes 210, for receipt of screws therethrough. The connecting block 200 of this embodiment has a pair of upstanding locking fingers 220 with no locking detents 222 thereon, in this embodiment. This transition block 200 includes a pair of side arms 212 extending generally parallel to the locking fingers 220, the side arms 212 being flexible so as to allow the hinge end 230 or the lock end 232 of a tensile connecting rod 234 shown in FIGS. 15A and 15B to snap between a retaining boss 214 on the distal most ends of each side arm 212. The retaining boss 214 fits into a recess 236 on either the hinge end 230 or the locking end 232 of a connecting rod 234 arranged between two of the connecting blocks 200. A small boss 240 is also arranged adjacent to the retaining boss 214, the small boss 240 fitting into a slot 242 on the side of the tensile connecting rod 234 to maintain that tension rod 234 into a fixed position when it is not in use or flipped against a work surface. The tensile connecting rod 234 for this embodiment is shown in FIGS. 15A and 15B. The recesses 236 have a depressed radius so as to receive the boss 214 from the flexible arms 202 on the transition blocks 200, as shown assembled in FIGS. 16A and 16B. The radial groove 242 is arranged at two locations on the pivot end 230 of the tensile connecting rod 234, and a radial groove 242 is arranged at one location on the locking end 232 of that tensile connecting rod 234. Those grooves 242 are arranged to receive the small boss 240 (shown in FIG. 14B) when the tensile connecting rod 234 is in its locked or unlocked position so as to help hold it in place. An L-shaped lever 244 extends off of the rounded shaft on the locking end 232 of the tensile connecting rod 234, to permit the tensile rod 234 to be manually engaged or disengaged on or under a work surface to which the transition blocks 200 are attached.

Figure 17:
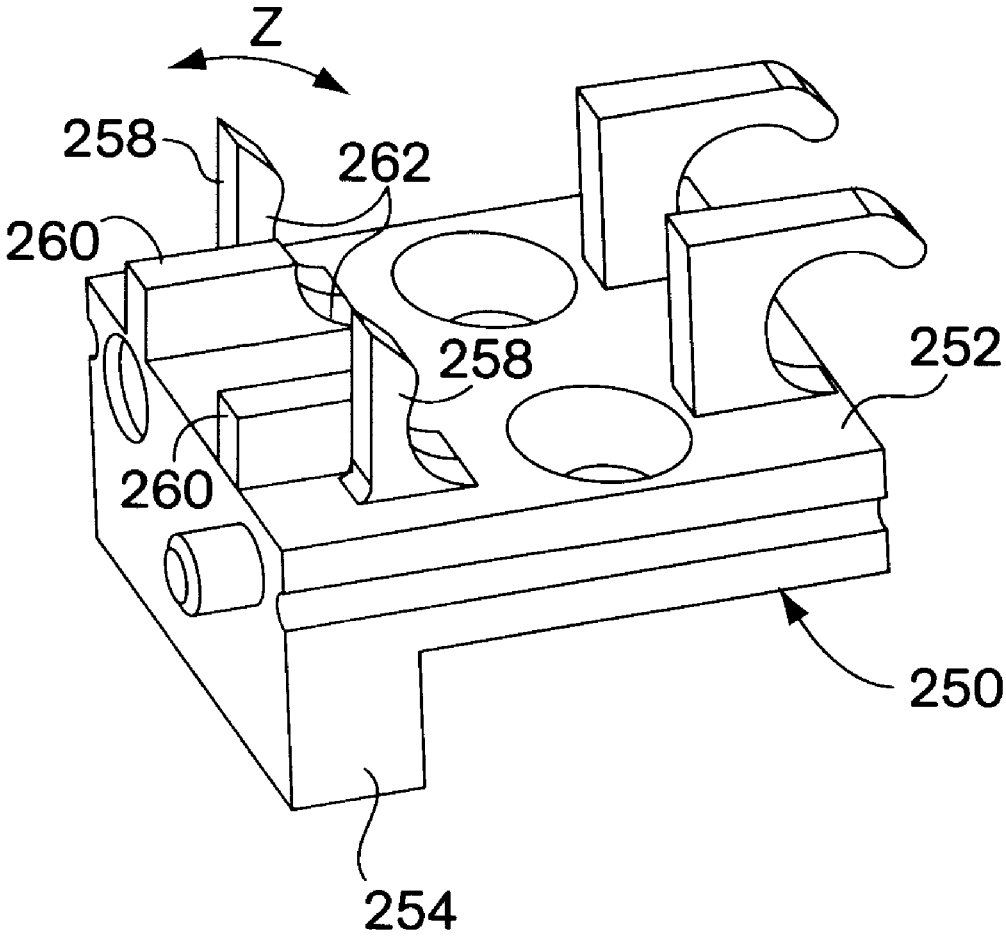
FIG. 17 is a perspective representation of an improved embodiment of the corner block shown in FIG. 4.

A further preferred embodiment of the corner block 250 is shown in FIG. 17, wherein a base 252 and edge 254 are arranged in a manner similar to the corner block 24 shown in FIG. 4. In this embodiment shown in FIG. 17, a pair of spring loaded locking fingers 258 are disposed parallel to and adjacent an inner pair of static stress bearing fingers 260 rigidly secured to the base 254. The spring loaded locking fingers 260 are pivotable about their lowermost edge, in an arc of 90 degrees, towards the edge 254, as indicated by arrow "Z". This articulation permits a rigid (non-elastic) tensile rod, not shown, to more readily snap into location to engage the curved cam locking detents 262 on both sets of fingers 258 and 260.

Figure 18:
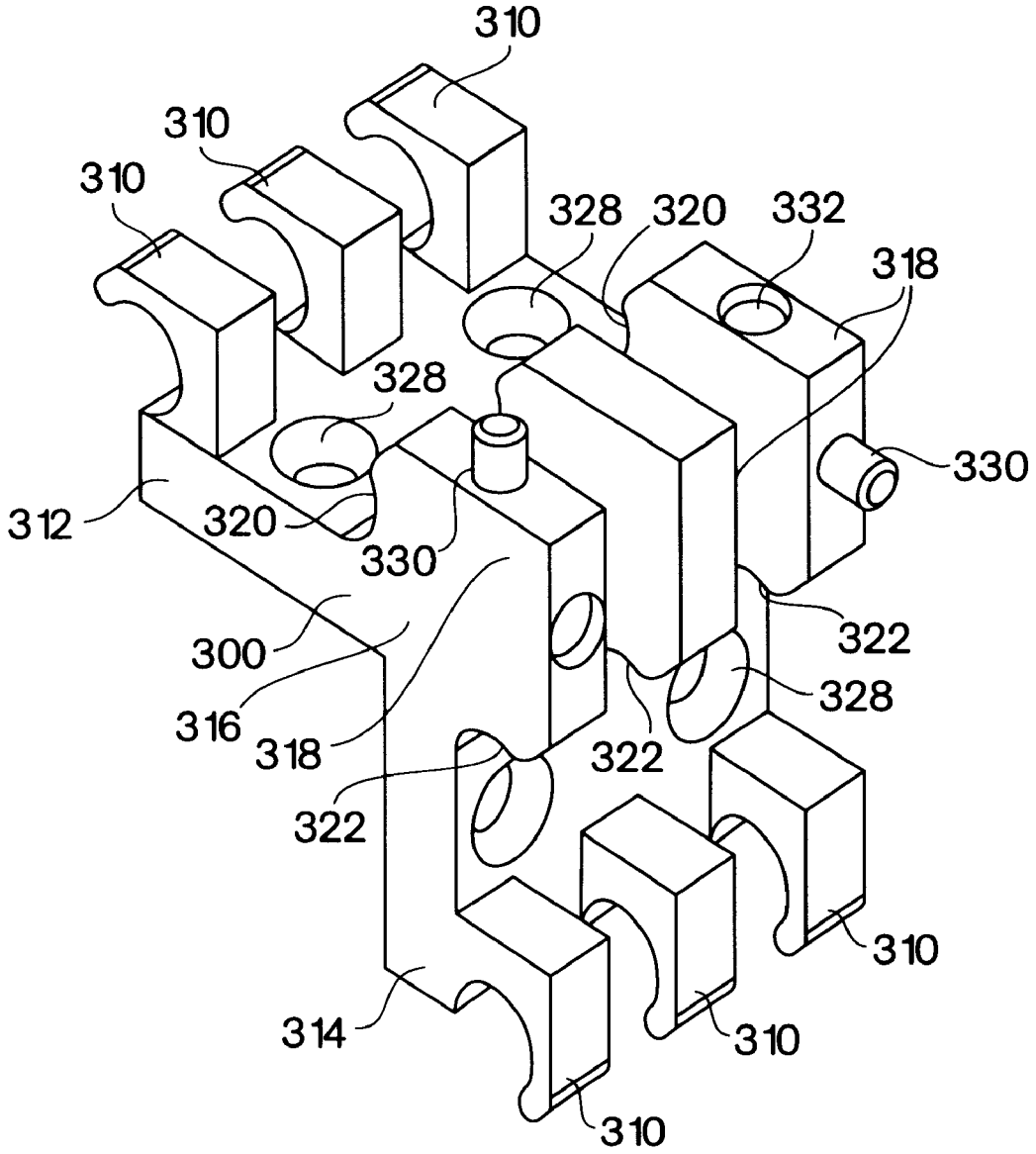
FIG. 18 is perspective representation of a unitary multiple side corner block.
Figure 19:
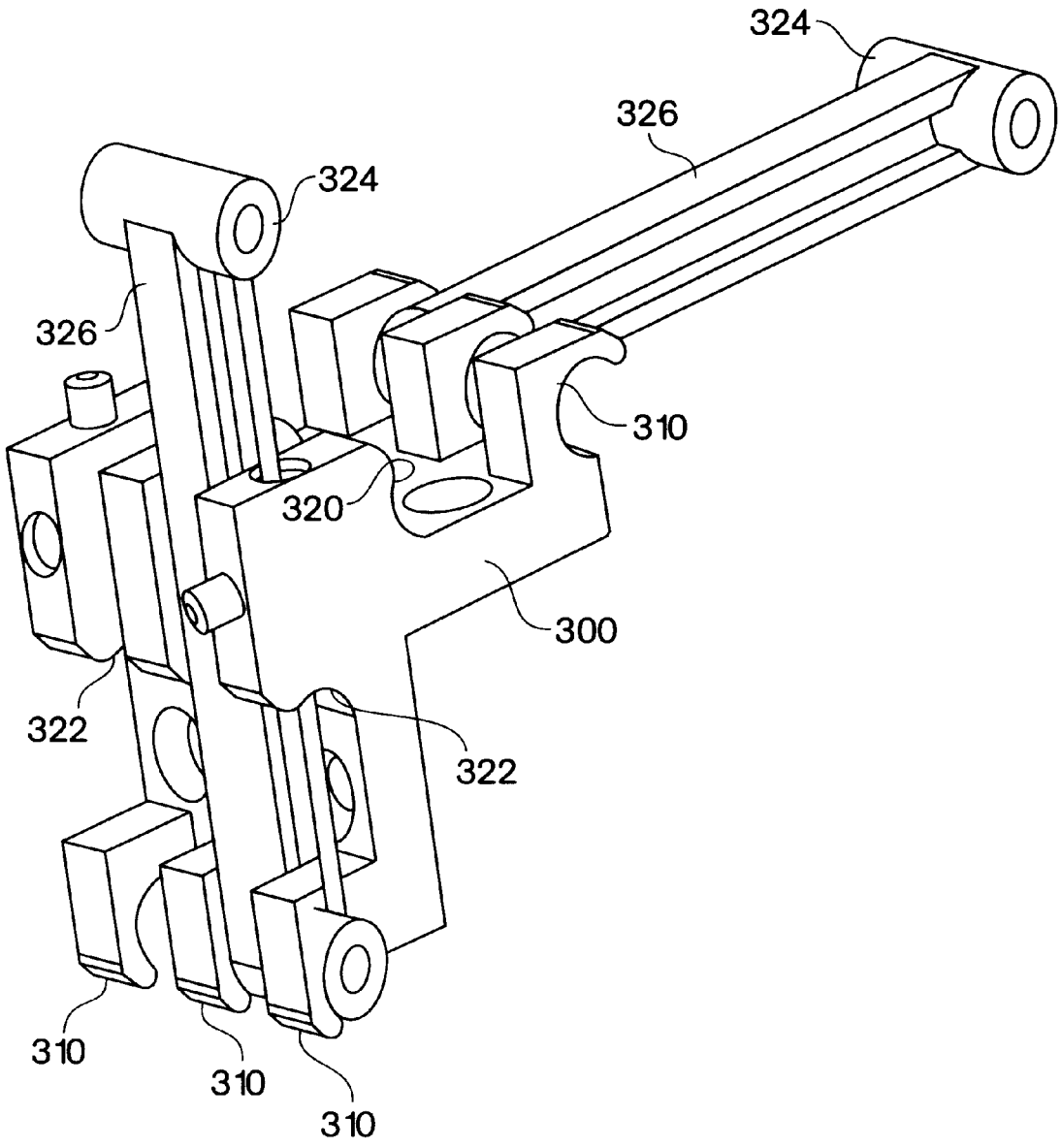
FIG. 19 is a perspective of the block shown in FIG. 18, with a pair of connecting rods arranged therewith.
Figure 20:
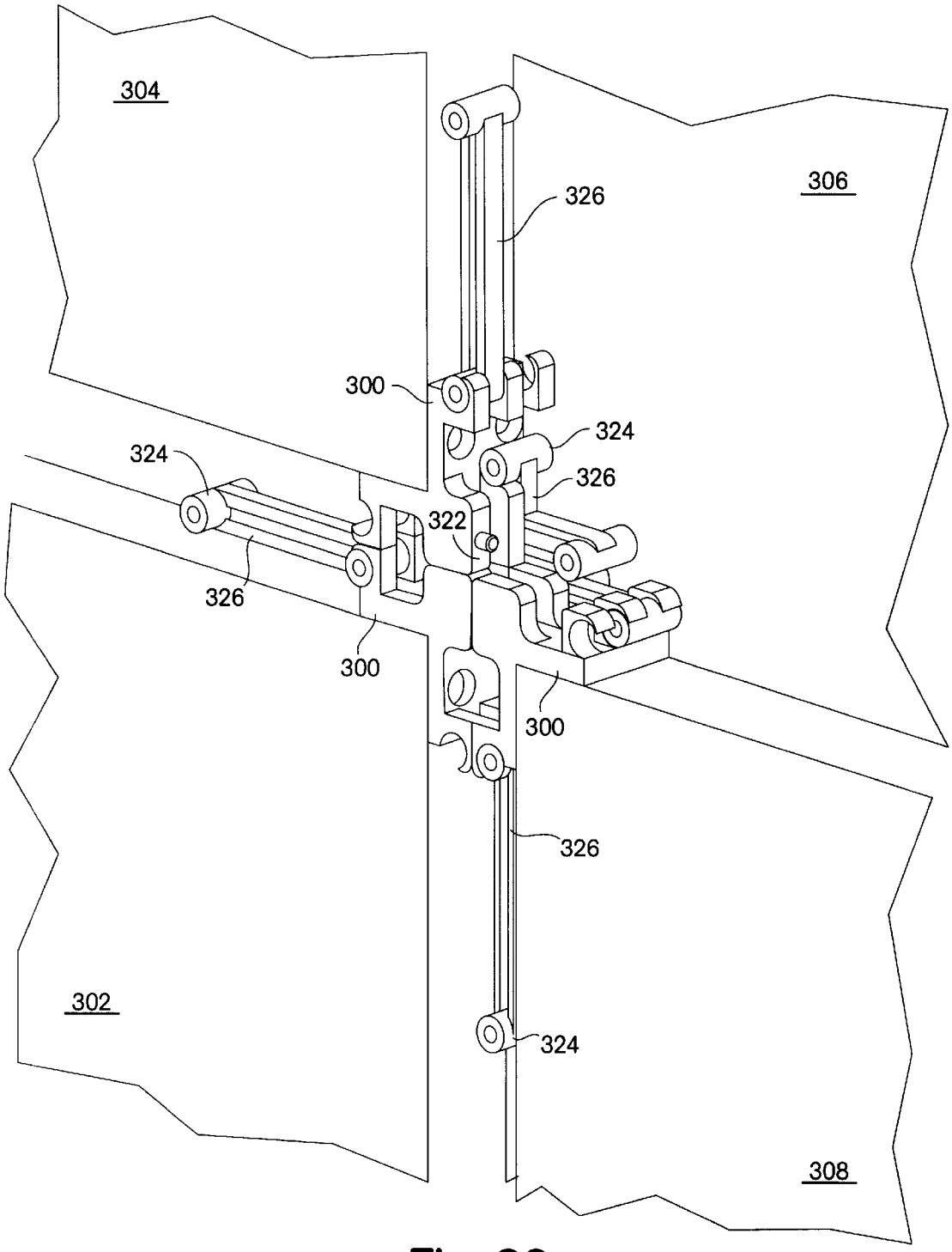
FIG. 20 is a perspective view of a plurality of panels joined at their corners by a plurality of multiple side corner blocks connecting those panels.

The preferred embodiments represented by FIGS. 18, 19 and 20 shows a multi-sided corner block 300 that is adaptable for connecting a plurality of panels 302, 304, 306 and 308. The multi-sided corner block 300 comprises an elongated "L" shaped body as shown in FIG. 18, having a first end 312 and a second end 314, with a plurality of pivot hinges 310 arranged at each end 312 and 314 thereof. The block 300 has a corner 316 with a double ended locking hinge 318 thereon, providing a cammed locking detent 320 and 322 arranged to receive a locking joint 324 of a connecting rod 326, as may be seen in FIG. 20. In this manner, one of the connecting rods 326 on a first block 300 attached to a first end 312 thereof may be connected to a set of second hinges 322 on a second block, and a further connecting rod 326 on the first block 300 may be connected to a set of first hinges 320 on yet a further block 300. Alternately, a pair of connecting rods 326 may be arranged in parallel to reinforce one another and help hold a pair of thick panels in alignment. The block 300 has a plurality of bolt holes 328, alignment pins 330 and alignment pin receiving holes 332, as may be seen in FIGS. 18 and 19. The multi-sided block 300 thus permits greater stability between attached panels 302 and 308, and an adaptability by virtue of multiple functional ends 312 and 314, each end having its own hinges 310 and locking fingers 318 and cam surfaces 320 and 322 respectively, in a manner not shown or taught in the art.

Thus it has been shown an improved arrangement for securely aligning, connecting and releasing a plurality of modular components together or onto a pre-existing wall or structure. The tensile connector arrangement assembly includes a pair of transition blocks, one on each panel or wall surface, one each arranged to pivotably hold a tensile connecting rod, the other arranged to receive and securely lock that tensile connecting from the first transition block. Each of the transition blocks have a pin and detent arrangement to permit proper alignment between the respective transition blocks and thus the panels or wall surfaces being connected.

I claim:

1. A modular panel arrangement for the assembly of a first panel to a second modular panel or a portion of a wall, comprising:

a modular panel of generally rectilinear configuration, having at least one edge thereon;

a first corner block attached to said edge of said panel;

an elongated tensile rod pivotally attached to a pivot hinge of said first corner block, said rod having a lug disposed transversely across at least on end of said rod; and a second corner block attached to said second panel or portion of said wall, said second block having at least one cammed locking finger on a base thereof, wherein said tensile rod is swingable about said pivot hinge on said first corner block to permit said lug thereon to engage a cam surface on said second corner block to lockably secure and align said edge of said first modular panel with said second modular panel or wall.

2. A modular panel arrangement for the assembly of a first panel to a second modular panel or a portion of a wall as recited in claim 1, wherein said tensile rod comprises an elongated shaft with an opening at one end thereof, said opening arranged to permit a tool to be inserted therein to facilitate unlocking of said lug from said second corner block.

3. A modular panel arrangement for the assembly of a first panel to a second modular panel or a portion of a wall as recited in claim 1, wherein an elastic bushing is arranged about said transverse lug.

4. A modular panel arrangement for the assembly of a first panel to a second modular panel or a portion of a wall as recited in claim 2, wherein said elongated shaft of said tensile rod is threaded on at least one end thereof.

5. A modular panel arrangement for the assembly of a first panel to a second modular panel or a portion of a wall as recited in claim 4, wherein said lug may be adjusted with respect to said locking finger by rotating said threaded shaft of said tensile rod.

6. A modular panel arrangement for the assembly of a first panel to a second modular panel or a portion of a wall as recited in claim 1, wherein said lug is a rotatable cam to permit rotative adjustment of said tensile rod with respect to said locking finger.

7. A modular panel arrangement for the assembly of a first panel to a second modular panel or a portion of a wall as recited in claim 1, including at least one upstanding guide adjacent to said pivot hinge to permit management of wires on said corner block.

8. A modular panel arrangement for the assembly of a first panel to a second modular panel or a portion of a wall as recited in claim 1, including an outer face arranged on one end of said corner block, said outer face having a pin locating hole thereon to permit a second block to be properly aligned therewith by a locating pin engaged therewithin.

9. A modular panel arrangement for the assembly of a first panel to a second modular panel or a portion of a wall as recited in claim 8, wherein said outer face has a locating pin thereon to permit said first block to be properly aligned with a second block.

10. A modular panel arrangement for the assembly of a first panel to a second modular panel or a portion of a wall as recited in claim 1, wherein said corner block comprises an elongated extrusion having an arrangement of cammed fingers on an upper end, and a knuckle joint at a lower end thereof, said knuckle joint engaging an arrangement of cammed fingers so as to engage said elongated extrusion corner block to said first panel.

11. A modular panel arrangement for the assembly of a first panel to a second modular panel or a portion of a wall as recited in claim 1, wherein said corner block includes a leg threadedly attached thereto, to permit height adjustment of a first panel to which said first block is attached.

12. A modular panel arrangement for the assembly of a first panel to a second modular panel or a portion of a wall as recited in claim 1, including:

a track connector having a narrow first end with a shaft transversely arranged thereon, and a wide second end with a plurality of engaging fingers extending therefrom, said shaft arranged to mate with said pivot hinge on said first corner block and said fingers arranged to mate with an accessory track attached to said second panel or wall portion.

13. A modular panel arrangement for the assembly of a first panel to a second modular panel or a portion of a wall as recited in claim 1, wherein said second corner block comprises a flat plate with at least one tension arm extending perpendicularly therefrom, said flexible arm having a pin on its distalmost end for engagement with said pivot hinge on said first corner block.

14. A modular panel arrangement for the assembly of a first panel to a second modular panel or a portion of a wall as recited in claim 13, wherein said second corner block is attached to a portion of a wall.

15. A modular panel arrangement for the assembly of a first panel to a second modular panel or a portion of a wall as recited in claim 1, wherein said first modular panel is comprised of a plurality of rigid frame arms connected by a hinge arrangement at their corners, said frame members being covered with a flexible fabric, to permit said first panel to be folded into a compact space.

16. A modular panel arrangement for the assembly of a first panel to a second modular panel or a portion of a wall as recited in claim 1, wherein said locking finger on said second corner block comprises a curved boss which engages a recess on said end of said lug on said tensile rod.

17. A modular panel arrangement for the assembly of a first panel to a second modular panel or a portion of a wall as recited in claim 1, wherein said cammed locking finger is pivotally arranged on said second corner block and is spring loaded on said base to permit said locking finger to move to allow a tensile rod to be readily engaged thereon, with a rigid locking finger arrangement thereadjacent.

18. A method of assembly a modular panel arrangement including a first panel to a second modular panel or a portion of a wall, comprising:

arranging a modular panel of generally rectilinear configuration, having at least one edge thereon adjacent a second modular panel or portion of a wall;

attaching a first corner block attached to said edge of said panel;

connecting an elongated tensile rod to a pivot hinge of said first corner block, said rod having a lug disposed transversely across at least on end of said rod; and attaching a second corner block attached to said second panel or portion of said wall, said second block having at least one cammed locking finger on a base thereof, and swinging said tensile rod about said pivot hinge on said first corner block to permit said lug thereon to engage a cam surface on said second corner block to lockably secure and align said edge of said first modular panel with said second modular panel or wall.

19. The method of assembly of a modular panel arrangement as recited in claim 18, including the step of:

adjusting said tensile rod by turning said lug on said end of said shaft.

20. The method of assembly of a modular panel arrangement as recited in claim 18, including the step of:

placing an opening in an end of said tensile rod to permit said tensile rod to receive a tool to facilitate said tensile from engagement from said second corner block.

* * * * *